US011492784B2

(12) United States Patent
Bilal

(10) Patent No.: US 11,492,784 B2
(45) Date of Patent: Nov. 8, 2022

(54) POSITION-BIASED LOCKING PIN ASSEMBLY FOR A GROUND ENGAGING WEAR MEMBER

(71) Applicant: Hensley Industries, Inc., Dallas, TX (US)

(72) Inventor: Mohamad Youssef Bilal, Little Elm, TX (US)

(73) Assignee: Hensley Industries, Inc., Dallas, TX (US)

( * ) Notice: Subject to any disclaimer, the term of this patent is extended or adjusted under 35 U.S.C. 154(b) by 106 days.

(21) Appl. No.: 16/843,623

(22) Filed: Apr. 8, 2020

(65) Prior Publication Data

US 2020/0325658 A1 Oct. 15, 2020

Related U.S. Application Data

(60) Provisional application No. 62/834,214, filed on Apr. 15, 2019.

(51) Int. Cl.
*E02F 9/28* (2006.01)

(52) U.S. Cl.
CPC ..... *E02F 9/2833* (2013.01); *E02F 9/2825* (2013.01); *E02F 9/2858* (2013.01)

(58) Field of Classification Search
CPC ..... E02F 9/2833; E02F 9/2841
See application file for complete search history.

(56) References Cited

U.S. PATENT DOCUMENTS

| | | | | |
|---|---|---|---|---|
| 2,635,366 | A * | 4/1953 | Hostetter | E02F 9/2841 37/459 |
| 4,133,121 | A | 1/1979 | Hemphill | |
| 4,823,487 | A | 4/1989 | Robinson | |
| 5,233,770 | A | 8/1993 | Robinson | |
| 5,361,520 | A | 11/1994 | Robinson | |
| 5,394,629 | A | 3/1995 | Ruvang et al. | |
| 5,491,915 | A | 2/1996 | Robinson | |
| 5,983,534 | A * | 11/1999 | Robinson | E02F 9/2841 37/459 |
| 6,108,950 | A | 8/2000 | Ruvang | |
| 6,393,739 | B1 | 8/2002 | Shamblin et al. | |

(Continued)

OTHER PUBLICATIONS

International Searching Authority, Notification of Transmittal of the International Search Report and the Written Opinion of the International Searching Authority, or the Declaration, dated Jul. 16, 2020, International Application No. PCT/US2020/028111, 154 pages, European Patent Office.

*Primary Examiner* — Gary S Hartmann
(74) *Attorney, Agent, or Firm* — Haynes and Boone, LLP

(57) ABSTRACT

A locking pin assembly for securing a wear member to a support structure may include a body portion and may include a shaft member partially disposed within and extending from the body portion and rotatable between a first position that mechanically inhibits removal of a ground engaging member from a support structure and a second position that permits removal of the ground engaging member from the support structure. A wear member for receiving a locking pin assembly may include a bore extending laterally through the bore member with a proximal opening and a distal opening, an installation ramp and a removal ramp may be disposed at the proximal opening for engaging a tang of a shaft member of the locking pin assembly.

31 Claims, 18 Drawing Sheets

(56) References Cited

U.S. PATENT DOCUMENTS

| | | | |
|---|---|---|---|
| 6,439,796 | B1 | 8/2002 | Ruvang et al. |
| 6,467,203 | B2 | 10/2002 | Pippins |
| 6,574,892 | B2 | 6/2003 | Creighton |
| 6,708,431 | B2 | 3/2004 | Robinson et al. |
| 6,729,052 | B2 | 5/2004 | Ollinger et al. |
| 6,757,995 | B2 | 7/2004 | Pippins |
| 6,799,386 | B2 | 10/2004 | Robinson et al. |
| 6,826,855 | B2 | 12/2004 | Ruvang |
| 6,959,506 | B2 | 11/2005 | Adamic et al. |
| 6,976,325 | B2 | 12/2005 | Robinson et al. |
| 7,069,676 | B2 | 7/2006 | Robinson et al. |
| 7,086,185 | B2 | 8/2006 | Pasqualini et al. |
| 7,121,023 | B2 | 10/2006 | Robinson et al. |
| 7,162,818 | B2 | 1/2007 | Ruvang et al. |
| 7,165,347 | B2 | 1/2007 | Ollinger et al. |
| 7,178,274 | B2 | 2/2007 | Emrich |
| 7,536,811 | B2 | 5/2009 | McClanahan |
| 7,603,799 | B2 | 10/2009 | Campomanes |
| 7,640,684 | B2 | 1/2010 | Adamic et al. |
| 7,681,341 | B2 | 3/2010 | Ruvang |
| 7,730,651 | B2 | 6/2010 | Carpenter |
| RE41,855 | E | 10/2010 | Ruvang et al. |
| 7,882,649 | B2 | 2/2011 | Carpenter et al. |
| 8,024,874 | B2 | 9/2011 | McClanahan et al. |
| 8,074,383 | B2 | 12/2011 | McClanahan |
| 8,122,621 | B2 | 2/2012 | Carpenter et al. |
| 8,127,475 | B2 | 3/2012 | Harder et al. |
| RE43,693 | E | 10/2012 | Emrich |
| 8,356,432 | B2 | 1/2013 | Carpenter |
| 8,387,290 | B2 | 3/2013 | Campomanes et al. |
| 8,393,097 | B2 | 3/2013 | Harder et al. |
| 8,578,637 | B2 | 11/2013 | Ollinger et al. |
| 8,689,472 | B2 | 4/2014 | Carpenter et al. |
| 8,898,937 | B2 | 12/2014 | Campomanes |
| 8,904,677 | B2 | 12/2014 | Cui |
| 9,249,558 | B2 | 2/2016 | Bierwith |
| 9,476,184 | B2 | 10/2016 | Wallis et al. |
| 9,562,347 | B2 | 2/2017 | Clendenning et al. |
| 9,650,764 | B2 | 5/2017 | Carpenter et al. |
| 9,957,696 | B2 | 5/2018 | Kunz et al. |
| 9,963,853 | B2 | 5/2018 | Ollinger et al. |
| 10,030,368 | B2 * | 7/2018 | Vegunta ..... E02F 9/2825 |
| 2003/0070330 | A1 | 4/2003 | Olds et al. |
| 2003/0101627 | A1 | 6/2003 | Robinson et al. |
| 2010/0162594 | A1 | 7/2010 | Bierwith |
| 2012/0051836 | A1 | 3/2012 | Jakubisin |
| 2012/0260539 | A1 | 10/2012 | Guimaraes et al. |
| 2013/0000162 | A1 | 1/2013 | Renski |
| 2014/0013635 | A1 | 1/2014 | Cui |
| 2015/0113839 | A1 | 4/2015 | Bilal |
| 2016/0083935 | A1 | 3/2016 | Edmonds |
| 2016/0130789 | A1 | 10/2016 | Tanaka et al. |
| 2017/0328035 | A1 | 11/2017 | Bilal et al. |

* cited by examiner

POSITION-BIASED LOCKING PIN ASSEMBLY FOR A GROUND ENGAGING WEAR MEMBER

PRIORITY

This application claims the benefit of the filing date of U.S. Provisional Application 62/834,214, filed Apr. 15, 2019, and titled Position-Biased Locking Pin Assembly For a Ground Engaging Wear Member, incorporated herein by reference in its entirety.

TECHNICAL FIELD

This disclosure is generally directed to an excavating tooth assembly including a locking pin assembly that secures components of the excavating tooth assembly. More particularly, this disclosure is directed to an excavating tooth assembly secured by a releasable locking pin assembly having an improved locking structure with rotational interference to prevent inadvertent unlocking.

BACKGROUND

Material displacement apparatuses, such as excavating buckets found on construction, mining, and other earth moving equipment, often include replaceable wear portions such as earth engaging teeth. These are often removably carried by larger base structures, such as excavating buckets, and come into abrasive, wearing contact with the earth or other material being displaced. For example, excavating tooth assemblies provided on digging equipment, such as excavating buckets and the like, typically comprise a relatively massive adapter portion which is suitably anchored to a structure of the equipment such as a forward bucket lip. The adapter portion typically includes a reduced cross-section, forwardly projecting nose. A replaceable tooth point typically includes an opening that releasably receives the adapter nose. To retain the tooth point on the adapter nose, generally aligned transverse openings are formed on both the tooth point and the adapter nose, and a suitable connector structure is driven into and forcibly retained within the aligned openings to releasably anchor the replaceable tooth point on its associated adapter nose.

There are a number of different types of conventional connector structures. One type of connector structure typically must be forcibly driven into the aligned tooth point and adapter nose openings using, for example, a sledge hammer. Subsequently, the inserted connector structure must be forcibly pounded out of the tooth point and adapter nose openings to permit the worn tooth point to be removed from the adapter nose and replaced. This conventional need to pound in and later pound out the connector structure can easily give rise to a safety hazard for the installing and removing personnel.

Various alternatives to pound-in connector structures have been previously proposed to releasably retain a replaceable tooth point on an adapter nose. While these alternative connector structures desirably eliminate the need to pound a connector structure into and out of an adapter nose, they typically present various other types of problems, limitations, and disadvantages including, but not limited to, complexity of construction and use or undesirably high cost.

Some types of connector structures are rotatable between a locked position and an unlocked position. However, the continuous vibration, high impact, and cyclic loading of the tooth point can result in inadvertent rotation of the connector structure from a locked position to an unlocked position. This may cause excess wear on the connector structure and tooth point interface and may affect the useful life of both the connector structure and the tooth point.

A need accordingly exists for an improved connector structure.

SUMMARY

According to one exemplary aspect, the present disclosure is directed to a position-biased locking pin assembly for securing a ground engaging member having side openings to a support structure alignable with the side openings.

In an aspect of the present disclosure, a locking pin assembly for securing a ground engaging member to a support structure includes a body portion, a shaft member, a locking feature, a biasing member, and a plunger. The body portion may be arranged to non-rotatably, selectively project into an opening in the support structure and may have an opening formed therein. The shaft member may have a distal end and a proximal portion, the distal end having a first engagement feature and the distal end being disposed within the body portion. The locking feature may comprise a tang which extends radially from the proximal portion of the shaft member outside the body portion. The shaft member may be rotatable relative to the body portion between a first position in which the locking feature is positionable to mechanically inhibit removal of the locking pin assembly from the ground engaging member when positioned to secure the ground engaging member to the support structure and a second position in which the locking feature is positionable to permit removal of the locking pin assembly from the ground engaging member when positioned to secure the ground engaging member to the support structure. The biasing member may be disposed within the body portion. The plunger may be disposed between the biasing member and the distal end of the shaft member and may include a second engagement feature configured to selectably engage the first engagement feature of the shaft member. The biasing member may urge the plunger toward the shaft member. The second engagement feature may be configured to engage the first engagement feature to provide resistance during rotation of the shaft member relative to the plunger in each of two opposing directions.

In an embodiment, the first engagement feature and the second engagement feature may be configured to rotate relative to one another when a rotational force applied to the shaft member exceeds a magnitude of the resistance to rotation exerted by the biasing member to rotate the shaft member from one of the first position and the second position to the other of the first position and the second position. The first engagement feature, the second engagement feature, and the biasing member may be configured so that the resistance to rotation exerted by the biasing member occurs during a first portion of rotational travel and does not occur during a second portion of rotational travel. One of the first and second engagement features may include two adjacent notches separated by a resistance peak, and the other of the first and second engagement features may include a tooth configured to selectably seat within each of the two notches. The resistance peak may be disposed approximately midway between the two adjacent notches. The two adjacent notches may be centered approximately 90 degrees apart. The other of the first and second engagement features may include a third notch and the resistance peak may be sized and shaped to fit within the third notch when the tooth is seated within one of the two adjacent notches.

The first engagement feature, the second engagement feature, and the biasing member may be configured so that rotation of the shaft member between the two adjacent notches provides haptic feedback to a user confirming transition from the first position to the second position, and from the second position to the first position.

In some embodiments, a locking pin assembly may include a rotation stopping element. The shaft member may include a partially circumferential groove formed therein. The rotation stopping element may be configured to mechanically interfere with opposing end portions of the groove to limit a range of rotation of the shaft member relative to the body portion. The groove may extend helically such that engagement of the rotation stopping element with the groove translates rotation of the shaft member into axial displacement of the shaft member with respect to the body portion. The rotation stopping element interfering with the end portions may limit rotation of the shaft member in a range of about 90 degrees relative to the body portion. The rotation stopping element may, for example, be a dowel extending through a portion of the body portion.

In some embodiments, a locking pin assembly may include a second rotation stopping element extending from the plunger and configured to prevent rotation of the plunger while permitting axial displacement of the plunger. The second rotation stopping element may include a second dowel fixed in relation to the body portion. The plunger may include an elongated recess into which the second dowel extends. Alternatively or additionally, the second rotation stopping element may include a protrusion extending from the plunger and fixed in relation thereto. The protrusion may extend into a longitudinal channel formed in an internal wall surface of the body portion.

In some embodiments, the shaft member and the plunger may define a longitudinally extending reference axis. A first cross-section of the body portion perpendicular to the reference axis adjacent a proximal end of the body portion may have a first cross-sectional area and a second cross-section of the body portion perpendicular to the reference axis adjacent a distal end of the body portion may have a second cross-sectional area less than the first cross-sectional area. The body portion may include an engagement surface along only one side that is parallel to the reference axis. In this regard, the locking pin assembly may be configured to be oriented within a bore extending through the ground engaging member and into the support structure such that at least a portion of the engagement surface engages a load bearing surface of the support structure defined by an internal wall of the bore. The load bearing surface may be disposed on a side of the bore at which the locking pin assembly exerts a force in response to a force tending to remove the wear member from the support structure.

Furthermore, in some embodiments, the body portion may be shaped to be received within a bore extending through the wear member and into the support structure such that when installed, the locking pin assembly is fixed in relation to the wear member but movable relative to the support structure. The body portion may include a head and the shaft member may extend through the head. The head may have a perimeter, a portion of the perimeter having a non-circular shape configured to be received within a correspondingly shaped recess in a wall of the wear member such that engagement of the head with a wall of the recess prevents rotation of the body portion.

In some embodiments, a locking pin assembly for securing a ground engaging member to a support structure may include a body portion, a head, and a tip. The body portion may include an outer surface having a proximal end and a distal end. The head may be disposed at the proximal end and may have a perimeter, a portion of the perimeter having a non-circular shape configured to be received within a correspondingly shaped proximal recess in a wall of the ground engaging member. The tip may be disposed at the distal end and a portion of the tip may have a non-circular peripheral profile, having at least one flat side, configured to be received within a correspondingly shaped distal recess in a portion of the ground engaging member opposite the first recess. Engagement of the head with the proximal recess and the tip with the distal recess may prevent rotation of the body portion relative to the ground engaging member.

A reference axis may extend longitudinally through the body portion. The outer surface may include an engagement surface along one side that is parallel to the reference axis. At least a portion of the outer surface opposite the engagement surface is nonparallel to the reference axis. For example, top, bottom, and rear sides of a body portion may be nonparallel to the front side. The locking pin assembly may be configured to be oriented within a bore extending through the ground engaging member and into the support structure such that at least a portion of the engagement surface is engageable with a load bearing surface of the support structure defined by an internal wall of the bore. The load bearing surface may be disposed on a side of the bore at which the locking pin assembly exerts a force in response to a force tending to remove the ground engaging member from the support structure.

In another aspect of the present disclosure, a wear member for installation on an adapter carried on earth engaging equipment using a locking pin assembly may include an external surface, and internal surface, a bore, an installation ramp, and a removal ramp. The internal surface may define a cavity within the wear member. The bore may pass through the wear member from the external surface on a first wall to the external surface on a second wall opposite the first wall. The installation ramp may be disposed adjacent the bore and configured to engage a first surface of a tang of the locking pin assembly when the locking pin assembly is disposed within the bore as the tang is rotated in a first direction from an unlocked configuration to a locked configuration. The removal ramp may also be disposed adjacent the bore and configured to engage a second surface of the tang opposite the first surface of the tang as the tang is rotated in a second direction opposite the first direction from the locked configuration to the unlocked configuration. In some embodiments, the installation ramp and removal ramp are integrated into the first wall. The installation ramp may be configured such that engagement of the installation ramp with the first surface translates rotation of the tang in the first direction into axial displacement of the locking pin assembly to facilitate seating of the locking pin assembly in the wear member. Similarly, the removal ramp may be configured such that engagement of the removal ramp with the second surface translates rotation of the tang in the second direction into axial displacement of the locking pin assembly to facilitate removal of the locking pin assembly from the wear member.

In yet another aspect of the present disclosure, a method for locking a wear member to or removing a wear member from an adapter carried on earth engaging equipment using a locking pin assembly may include first rotating, while the locking pin assembly is disposed within a bore passing through the wear member and the adapter, a shaft member of the locking pin assembly relative to a body portion of the locking pin assembly in a first direction through a first range of motion (or "portion of travel") in which a first surface of a tooth of the shaft member engages a corresponding first surface of a notch of a plunger disposed within the body portion. The plunger may be substantially rotationally fixed with respect to the body portion and rotation of the shaft member through the first range of motion axially displaces the plunger toward a biasing member from an initial position to a compressed position. The method may further include second rotating the shaft member relative to the body portion in the first direction through a second range of motion in which a second surface of the tooth slide s relative to a corresponding second surface of the notch. During rotation of the shaft through the second range of motion the biasing member may return the plunger to the initial position. The first and second rotating may move a locking feature of the locking pin assembly, such as a tang extending from the shaft member, from a first configuration to a second configuration. When the locking feature is in one of the first and second configurations, the locking feature may interface with the wear member or the adapter to prevent withdrawal of the locking pin assembly from the wear member and when the locking feature is in the other of the first and second configurations the locking pin assembly is removable from the wear member.

In some embodiments, the first range of motion includes a range between 0 and 180 degrees and the second range of motion includes a range between 0 and 180 degrees. For example, in some embodiments one or both of the first and second ranges of motion may include a range between 20 and 160 degrees, between 40 and 140 degrees, between 70 and 100 degrees, etc.

In additional implementations, the present disclosure is directed to a locking pin assembly for securing a ground engaging member to a support structure. The locking pin assembly may include a body portion arranged to non-rotatably, selectively project into an opening in the support structure. The body portion having an opening formed therein. A shaft member may have a first axis and may comprise a distal end and a proximal portion, with the distal end having a first plurality of equidistantly spaced teeth. The first plurality of equidistantly spaced teeth may be spaced radially about the first axis in a range between about 30 degrees and 120 degrees apart, with the distal end being disposed within the body portion. A tang may extend radially from the proximal portion of the shaft member outside the body portion. The shaft member may be rotatable relative to the body portion between a first position in which the tang is positionable to mechanically inhibit removal of the locking pin assembly from the ground engaging member when positioned to secure the ground engaging member to the support structure and a second position in which the tang is positionable to permit removal of the locking pin assembly from the ground engaging member when positioned to secure the ground engaging member to the support structure. A biasing member may be disposed within the body portion. A plunger may be disposed between the biasing member and the distal end of the shaft member, the plunger having a second axis and comprising a second plurality of equidistantly spaced teeth. The second plurality of equidistantly spaced teeth being spaced radially about the second axis in a range between about 30 degrees and 120 degrees apart and shaped to selectively engage the first plurality of equidistantly spaced teeth of the shaft member to provide resistance to rotation in two opposing directions. In some aspects, the first and the second pluralities of equidistantly spaced teeth are shaped to provide about equal resistance to rotation in two directions.

In yet another exemplary aspect the present disclosure is directed to a locking pin assembly for securing a ground engaging member to a support structure. The locking pin assembly may include a body portion having an opening formed therein and may include a shaft member having a first axis and comprising a distal end and a proximal portion. The distal end may have a projecting tooth extending in an axial direction and offset from the first axis, the distal end may be disposed within the body portion. A tang may extend radially from the proximal portion of the shaft member outside the body portion. The shaft member may be rotatable relative to the body portion between a first position in which the tang is positionable to mechanically inhibit removal of the locking pin assembly from the ground engaging member when positioned to secure the ground engaging member to the support structure and a second position in which the tang is positionable to permit removal of the locking pin assembly from the ground engaging member when positioned to secure the ground engaging member to the support structure. A biasing member may be disposed within the body portion. A plunger may be disposed between the biasing member and the distal end of the shaft member. The plunger may have a second axis and may comprise a second tooth extending in a proximal direction and offset from the second axis. The second tooth may engage the first tooth to provide resistance to rotation in two opposing directions. In some aspects, one of the shaft member and the plunger comprises a notch adjacent the respective first tooth or second tooth, each of the first tooth and the second tooth sized to form a radial arc in a range between about 30 degrees and 120 degrees about the first axis and the second axis respectively.

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following.

BRIEF DESCRIPTION OF THE DRAWINGS

The accompanying drawings illustrate implementations of the systems, devices, and methods disclosed herein and together with the description, serve to explain the principles of the present disclosure.

Figure 1:
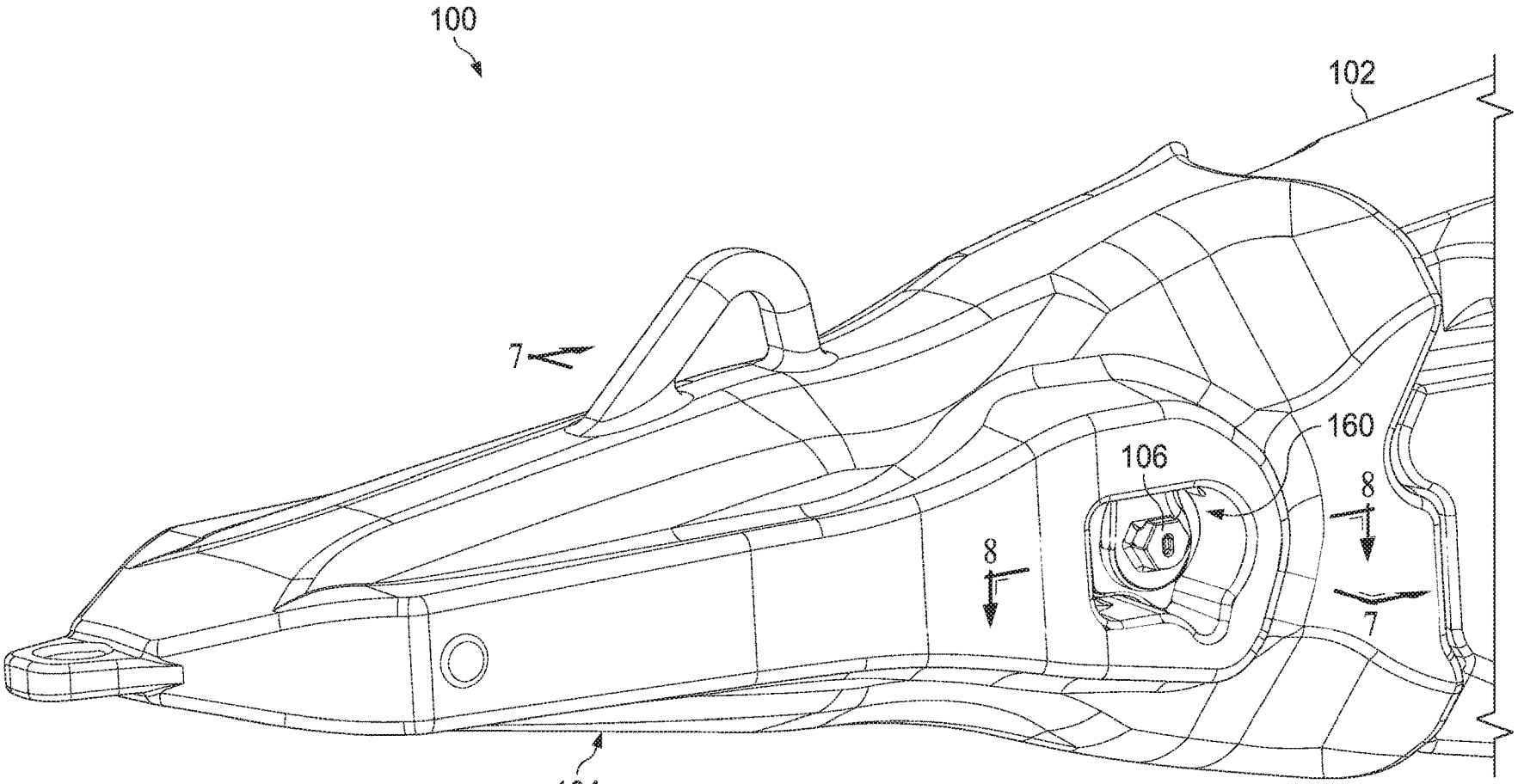
FIG. 1 is an assembled perspective view of an excavating tooth assembly embodying principles of the present disclosure.

These Figures will be better understood by reference to the following detailed description.

DETAILED DESCRIPTION

For the purpose of promoting an understanding of the principles of the present disclosure, reference will now be made to the implementations illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other implementations or Figures of the present disclosure. For simplicity, in some instances the same or similar reference numbers are used throughout the drawings to refer to the same or like parts.

The present disclosure is directed to an excavating tooth assembly including a locking pin assembly that is arranged to removably secure an adapter to a wear member such as an excavating tooth. The locking pin assembly includes a radially extending rotatable locking element (or "tang") that engages an internal surface of the wear member and mechanically prevents the locking pin assembly from inadvertently being removed. A biasing member causes mechanical interference with rotation of the tang from a locked position to an unlocked position. During rotation of the tang with respect to a body portion of the locking pin assembly from the locked position to the unlocked position, and from the unlocked position to the locked position, resistance against the rotation is provided during a first range of motion and no resistance is provided during a second range of motion. This feature provides haptic feedback to a user, assuring that the locking pin assembly has been properly transitioned from locked to unlocked, or vice versa. In addition, the resistance against rotation may help reduce or minimize a chance of inadvertent rotation.

Since the locking pin assembly employs mechanical interference to prevent inadvertent rotation of locking pin assembly components, the locking pin assembly may be able to withstand vibration, high-impact, and cyclic loading while minimizing the chance of becoming inadvertently unlocked. In addition, some embodiments of the locking pin assembly may be arranged to emit an audible noise such as a click when the locking pin assembly achieves a locked condition. Because of this, users such as machinery operators may have an easier time installing new wear members and replacing old wear members than can be done with conventional connector pins.

Figure 2:
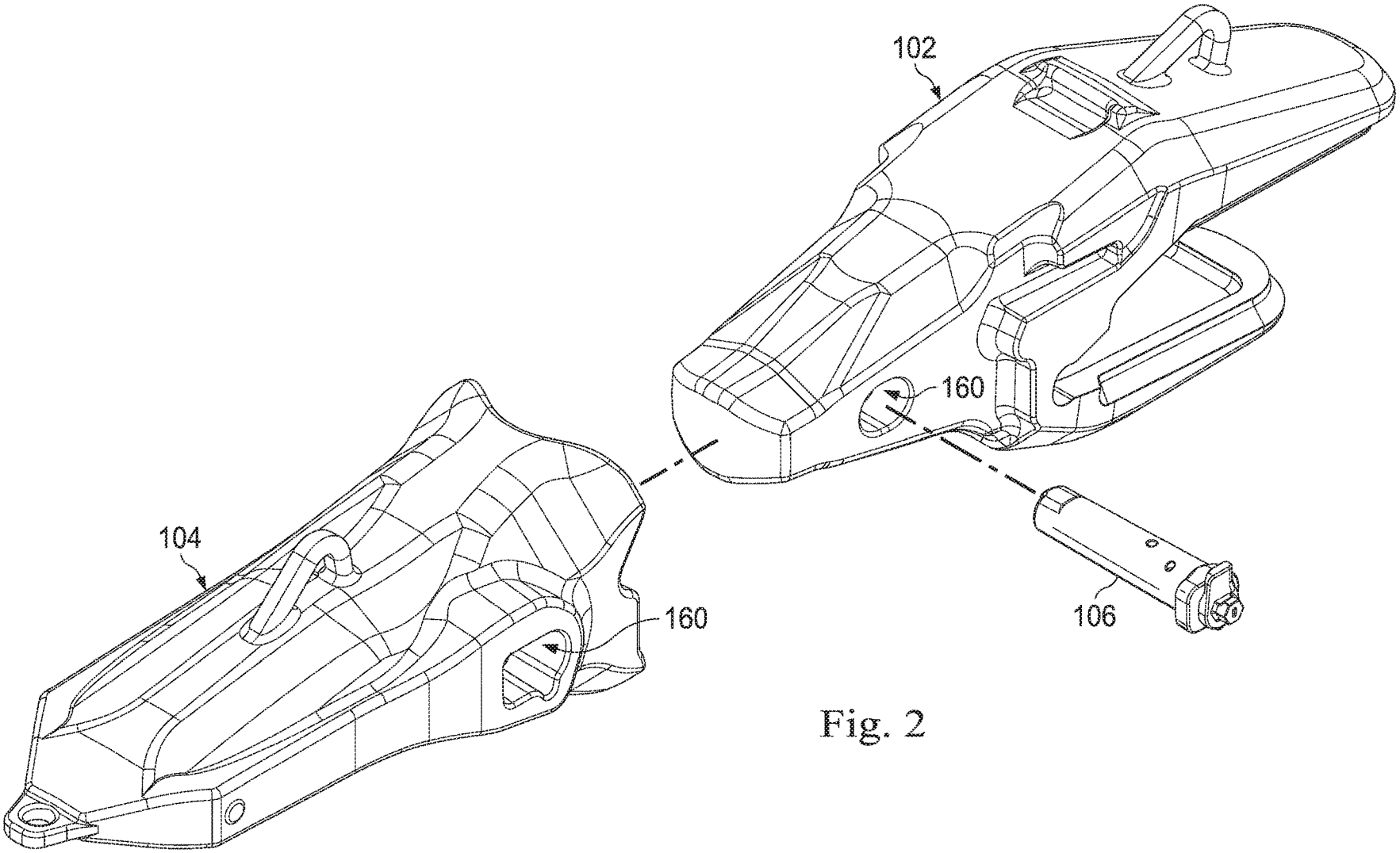
FIG. 2 is an exploded perspective view of the assembly of FIG. 1.

FIGS. 1 and 2 show an exemplary embodiment of an assembly according to the present disclosure, which in the illustrated embodiment is an excavating tooth assembly 100, including wear member 104 (or "ground engaging member") representatively in the form of a replaceable tooth point mounted to an adapter 102 (or "support structure") with a locking pin assembly 106. It should be appreciated that assemblies according to the present disclosure may include any type of ground engaging member and a corresponding support structure to which a ground engaging member is affixed with a pin. The excavating tooth assembly 100 may find particular utility on earth moving equipment. For example, the excavating tooth assembly 100 may be used in construction, mining, drilling, and other industries. The adapter 102 has a rear base portion including a fork which may receive and be welded or otherwise affixed to, for example, a lip of a bucket. Extending from the rear base portion is a nose portion that forwardly projects for receiving the wear member 104. Extending through opposite vertical sides of both the wear member and nose portion is a transverse bore 160 into which the locking pin assembly 106 may be inserted to retain the wear member 104 on the adapter 102. It is worth noting that the tooth assembly 100 may also include one or more intermediate adapters, and the locking pin assembly 106 may be inserted to retain the intermediate adapter, as a wear member, on the adapter 102, or may be used to retain the wear member 104 on an intermediate adapter. It should be appreciated that in alternative embodiments, the bore may not extend all the way through the adapter. Furthermore, in some embodiments, a first bore may extend into a first side of the adapter and a second bore may extend into a second side of the adapter. In such embodiments, two locking pin assemblies may be utilized.

The locking pin assembly 106 is sized and shaped to be received within the bore 160 of the wear member 104 and the adapter 102. As described herein, the locking pin assembly 106 may removably secure the wear member 104 in place on the adapter 102. In addition, at least a portion of the locking pin assembly 106 may be manipulate d between an unlocked position and a locked position. When the wear member 104 is properly positioned on the adapter 102, the locking pin assembly 106 may be manipulated from the unlocked position to the locked position. When in the locked position, the locking pin assembly 106 may prevent removal of the wear member 104 from the adapter 102 by mechanically blocking the wear member 104 from separating from the adapter 102. When desired, a user such as an operator may manipulate the locking pin assembly 106 from the locked position to the unlocked position. This may permit the user to remove the locking pin assembly 106 from the bore 160, and subsequently the wear member 104 from the adapter 102.

Figure 3A:
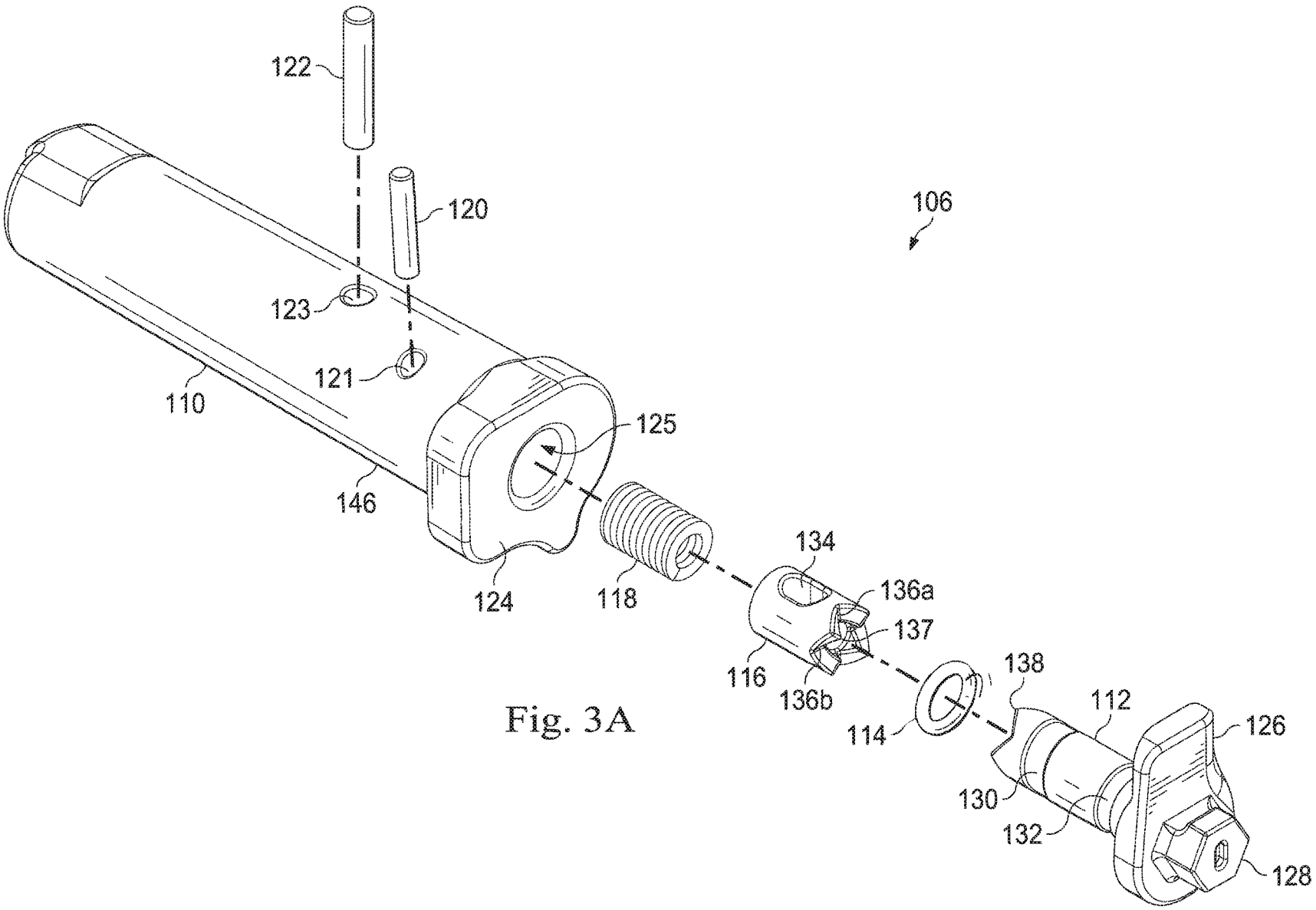
FIG. 3A is an exploded perspective view of a locking pin assembly according to the present disclosure.

Turning to the exploded view of FIG. 3A, the locking pin assembly 106 includes, among other components, a body portion 110 and a shaft member 112. The body portion 110 may be a body having an outer surface 146 that corresponds with the shape of the bore 160. The shaft member 112 is partially disposed within and extends from the locking cavity 125, which is an opening in the body portion 110 through the head 124. In some examples including the example in FIG. 3A, the locking cavity 125 is a substantially cylindrical bore extending part-way through the body portion 110. A distal portion of the shaft member 112 has a cylindrically shaped outer surface sized and arranged to fit within the locking cavity 125. In this embodiment, the shaft member 112 has a clearance fit so that it may rotate within the locking cavity 125.

Shaft member 112 includes a tang 126 which protrudes radially from the shaft member 112 outside of the body portion 110. The tang 126 is the feature which provides mechanical interference with the wear member 104 to prevent the locking pin assembly 106 from being extracted from the bore 160 in the locked position. Using a tool engagement feature 128, the shaft member 112 may be rotated to rotate the tang 126 to transition the locking pin assembly 106 from the unlocked position, in which the tang 126 clears a portion of the wear member 104 during insertion and removal, to the locked position, in which the tang 126 engages the portion of the wear member 104. In this embodiment, the tool engagement feature 128 includes a hex shaped tool recess configured to receive a hex shaped tool, such as a hex key wrench, and also includes a hexagonal outer surface configured for engagement by a crescent wrench or socket. Other tool interfaces and tools could be used as would be apparent to one of ordinary skill in the art.

The tool engagement feature 128 is sized and arranged to receive a work tool (not shown) that may be handled by a user. The work tool may be inserted into the tool engagement feature 128 and turned to rotate the shaft member 112 to manipulate the locking pin assembly 106 from the locked position to the unlocked position and vice versa.

The shaft member 112 interacts with the plunger 116 and the biasing member 118 during rotation to provide resistance to the rotation, which prevents inadvertent unlocking, and to provide haptic feedback to a user. It should be appreciated that the shaft member 112 may be rotated in opposite directions without axially displacing the shaft member 112. In this regard, the shaft member 112 may be rotated both clockwise and counter-clockwise while experiencing a resistance to that rotation due to continuous contact between the shaft member 112 and the plunger 116.

The biasing member 118, which is a coil spring in the illustrated embodiment, but could be any suitable spring or biasing mechanism, rests against a distal wall of the locking cavity 125 on one end and engages the plunger 116 at the other end. In this regard, the plunger 116 may be biased toward the shaft member 112 and resist axial movement tending to push the plunger 116 further into the locking cavity 125.

It may be desirable to prevent rotation of the plunger 116 to ensure resistance against rotation of the shaft member 112 is provided by the plunger 116. In that regard, the plunger 116 may include a rotation stopping element. In the illustrated embodiment, the rotation stopping element comprises a plunger dowel 122 disposed in a dowel recess 123 which intersects the locking cavity 125. The plunger dowel 122 passes through an elongated aperture 134 of the plunger 116. The elongated shape of the elongated aperture 134 allows the plunger 116 to slide axially within the locking cavity 125 but not rotate with respect to the body portion 110. It should be appreciated that plunger dowel 122 is removable from dowel recess 123 to facilitate disassembly of the locking pin assembly 106, for example for cleaning or repair, but it is contemplated that the plunger dowel 122 or another rotation stopping element may be integrally formed with the body portion 110.

In an alternative embodiment, the rotation stopping element may comprise a protrusion extending from the plunger. This protrusion may be disposable within a longitudinal channel formed on the internal wall surface of the locking cavity 125. In this regard, the plunger 116 may be free to slide axially within the locking cavity 125 as the protrusion slides within the longitudinal channel. However, rotation of the plunger 116 would be prevented by mechanical interference of the sidewalls of the longitudinal channel with the protrusion.

A shaft dowel 120 may be disposed in a dowel recess 121 which intersects locking cavity 125 to engage a groove 130 on the shaft member 112. As with plunger dowel 122, shaft dowel 120 may be removable or may be permanently affixed to the body portion 110. The groove 130 is arranged such that it extends substantially laterally with respect to the shaft member 112 rather than longitudinally. In this regard, the shaft member 112 is rotatable, but axial movement is substantially restricted by interference between the shaft dowel 120 and the groove 130, as described in more detail below with reference to FIGS. 5A-6. This restriction of axial movement caused by the shaft dowel 120 retains the shaft member 112 in the locking cavity 125, and prevents the shaft member 112 from being displaced in response to a force exerted on the shaft member 112 by the plunger 116 during rotation of the shaft member 112. It should be appreciated that the shaft dowel 120 and the groove 130 are only an exemplary means of restricting the axial movement of shaft member 112 and other suitable means of restricting axial movement of the shaft member 112 while permitting rotation are considered to be within the scope of this disclosure.

An interface between the shaft member 112 and the plunger 116 may include crown-like features to facilitate the rotational resistance of the shaft member 112 as teeth extending from the non-rotatable plunger 116 grip corresponding teeth extending from the shaft member 112. As described herein, each pair of adjacent teeth of the shaft member 112 forms a notch configured to receive a corresponding tooth of the plunger 116, and vice versa. The furthest extent of a tooth may be referred to as a resistance peak as this narrowest point of a tooth may correspond to a rotational position at which resistance reaches a maximum due to maximum compression of the biasing member 118. As a tooth of one member (shaft member 112 or plunger 116) crosses over a resistance peak of the other member, resistance may drop to zero as the tooth begins to slide and snap into a seated position. Although illustrated as a plurality of jagged teeth, it should be appreciated that the teeth and notches may be formed from smooth, wavelike curves. Such a profile may provide less rotational resistance than the illustrated embodiment but may have an extended service life or other advantage. In some implementations, the teeth are shaped to provide about equal resistance to rotation in two opposing directions.

In a preferred embodiment, each of the shaft member 112 and the plunger 116 may have four equidistantly spaced teeth. In this regard, rotation of the shaft member 112 from the locked position to the unlocked position, would include approximately 90 degrees of rotation corresponding to realignment of a tooth 138 of the shaft member 112 from a notch 136*a* of the plunger 116 to an adjacent notch 136*b*. To return the shaft member 112 to the locked position, the rotation would be reversed. It will be appreciated that more or less teeth may be provided, such as one tooth on one engagement feature and two notches on the other engagement feature. Alternatively, each engagement feature may include 5 teeth, 10 teeth, or more. The range of rotation between adjacent tooth/notch pairs may increase or decrease corresponding to a decrease or increase in the number of teeth and notches.

In some implementations, the teeth are selected to between about 30 degrees and 120 degrees apart. For example, some implementations utilize three teeth spaced about 120 degrees apart. Some implementations utilize twelve teeth spaced about 30 degrees apart.

Figure 3B:
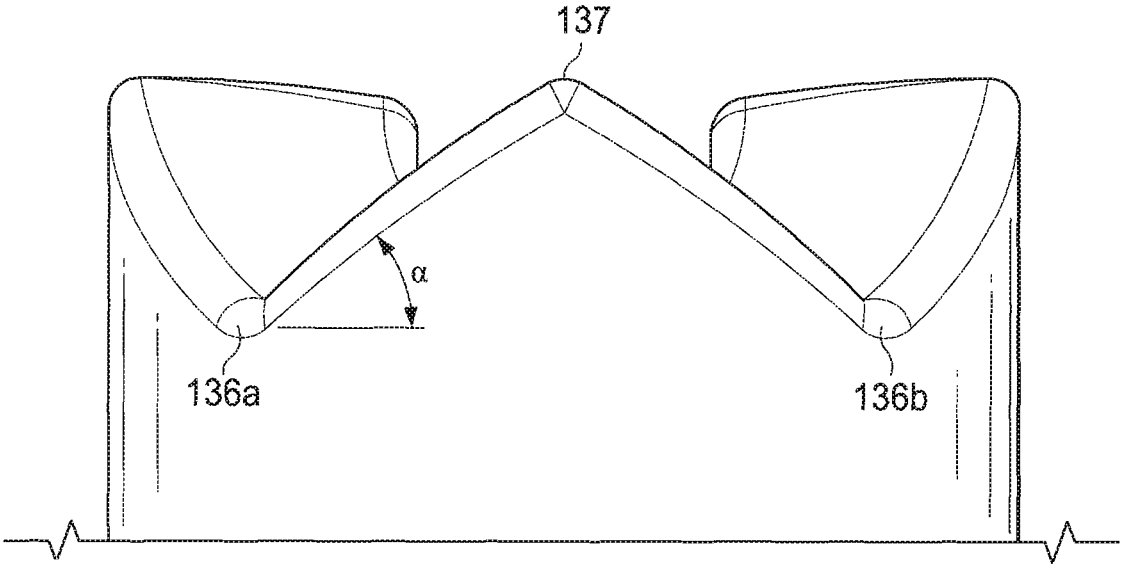
FIG. 3B illustrates an example of a tip of the plunger of FIG. 3A.

As seen in FIG. 3B, each tooth is defined by a resistance peak 137 extending between two notches 136*a*, 136*b*, each tooth oriented at an angle α with respect to the direction of rotation of the shaft member 112. It is contemplated that angle α may be any suitable angle that provides resistance to rotation while still allowing rotation of the shaft member 112. In the illustrated embodiment, angle α may be between about 45-75°. In an example, the angle α may be, for example, about 59°. Interaction between each tooth of the shaft member 112 and the corresponding teeth of the plunger 116 translates the rotation into an axial force having a component transverse to the direction of rotation. Because axial movement of the shaft member 112 is restricted by the shaft dowel 120, this force causes axial displacement of the plunger 116 against the biasing member 118 during a first portion of travel corresponding to the upward slope of one angled surface of each tooth. Once the resistance peak of each tooth 138 of the shaft member 112 clears the resistance peak 137 of a corresponding tooth of the plunger 116, a second portion of travel begins in which there is no resistance to rotation. In fact, in some implementations, the rotation is urged during the second portion of travel as the resistance peak of each tooth of the shaft member 112 slides across the downward slope of a corresponding second surface of each tooth of the plunger 116, snapping the shaft member 112 into a fully seated position with respect to the plunger 116 as the plunger 116 is pushed back to its initial position by the biasing member 118. In some embodiments, by forming each tooth from two adjacent surfaces of similar slopes and similar lengths, reciprocal movement of the shaft member 112 with respect to the plunger 116 between locked and unlocked positions may be facilitated with a similar degree of resistance provided by the crown-like interface, yielding a similar haptic feedback to a user in both directions of rotation which confirms a complete transition of a tooth from one notch to an adjacent notch. In the illustrated example in which adjacent teeth are 90 degrees apart, transition of a tooth 138 from one notch 136*a* to an adjacent notch 136*b* corresponds to 90 degrees of rotation between the locked position and the unlocked position.

Figure 3C:
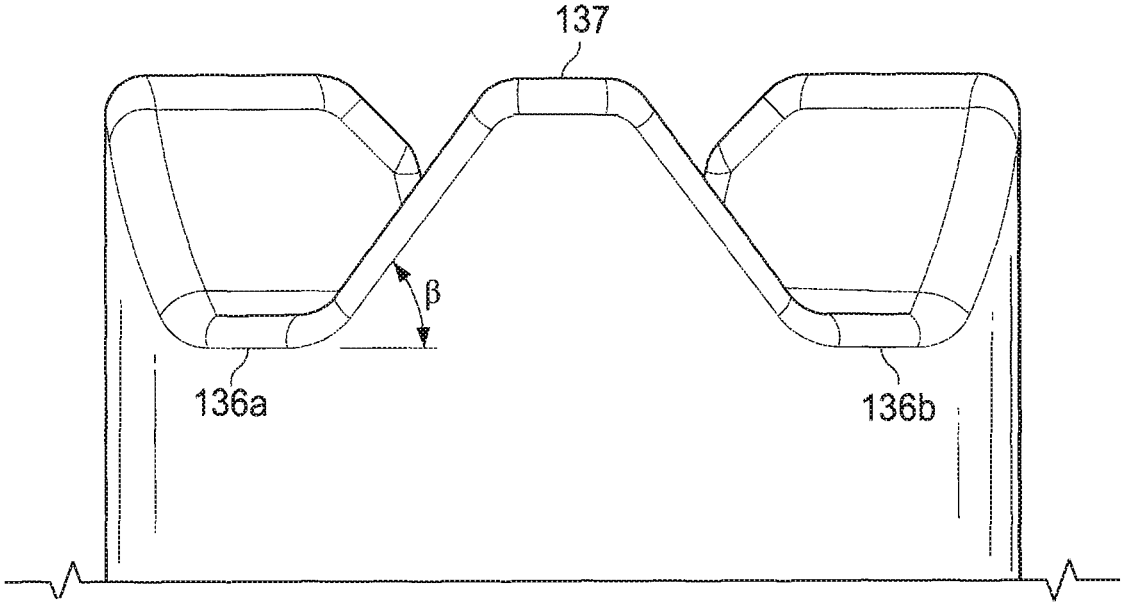
FIG. 3C illustrates an alternative example of a tip of a plunger.

FIG. 3C illustrates an alternative embodiment of the tip of the plunger of FIG. 3B. In this alternative embodiment, each tooth of the plunger 116 may have a generally flat segment comprising a planar surface at the resistance peak 137 and a corresponding flat segment at the base of the notches 136*a*, 136*b*. The flat surface may extend between a first angled surface and a second angled surface which define a tooth of the plunger. The shaft member 112 may have teeth corresponding in shape to those of the plunger of FIG. 3C. It is contemplated that angle θ may be any suitable angle that provides resistance to rotation while still allowing rotation of the shaft member 112. In the illustrated embodiment, angle β may be between about 60-80°, and in some examples, about 72-73°. The greater angle of β as compared to angle α may provide increased resistance to rotation, and may also impact the rotational distance required to achieve full axial displacement. For example, in FIG. 3B, full axial displacement (using a four-tooth example) may be accomplished with rotation of about 90 degrees. In the example of FIG. 3C, full axial displacement (using a four-tooth example) may be accomplished with rotation of about 60-85 degrees. It should be appreciated, however, that other factors such as the spring-constant of the biasing member 118 may also impact the rotational resistance provided.

It should be appreciated that the functionality described above in relation to the crown-like interface may be facilitated by providing a single tooth 138 extending from the shaft member 112 and two notches formed in the plunger 116, or vice versa. However, a plurality of teeth and a plurality of notches may be desirable to extend the service life of the locking pin assembly 106 by distributing the forces between the plunger 116 and the shaft member 112 across multiple tooth interfaces. Additionally, distributing a plurality of teeth and notches symmetrically around the interface may aid in maintaining linear alignment of the plunger 116 and shaft member 112, thereby preventing binding of the components within the locking cavity 125 and providing a predictable and consistent resistance to rotation of the shaft member 112.

An O-ring 114 may be fitted in a fully circumferential groove 132 of the shaft member 112. When the locking pin assembly 106 is assembled, the O-ring 114 may provide a seal between the shaft member 112 and the internal wall of the locking cavity 125. This seal may be effective for preventing debris from entering the locking cavity 125 and interfering with movement of the plunger 116 and the biasing member 118.

Figure 4A:
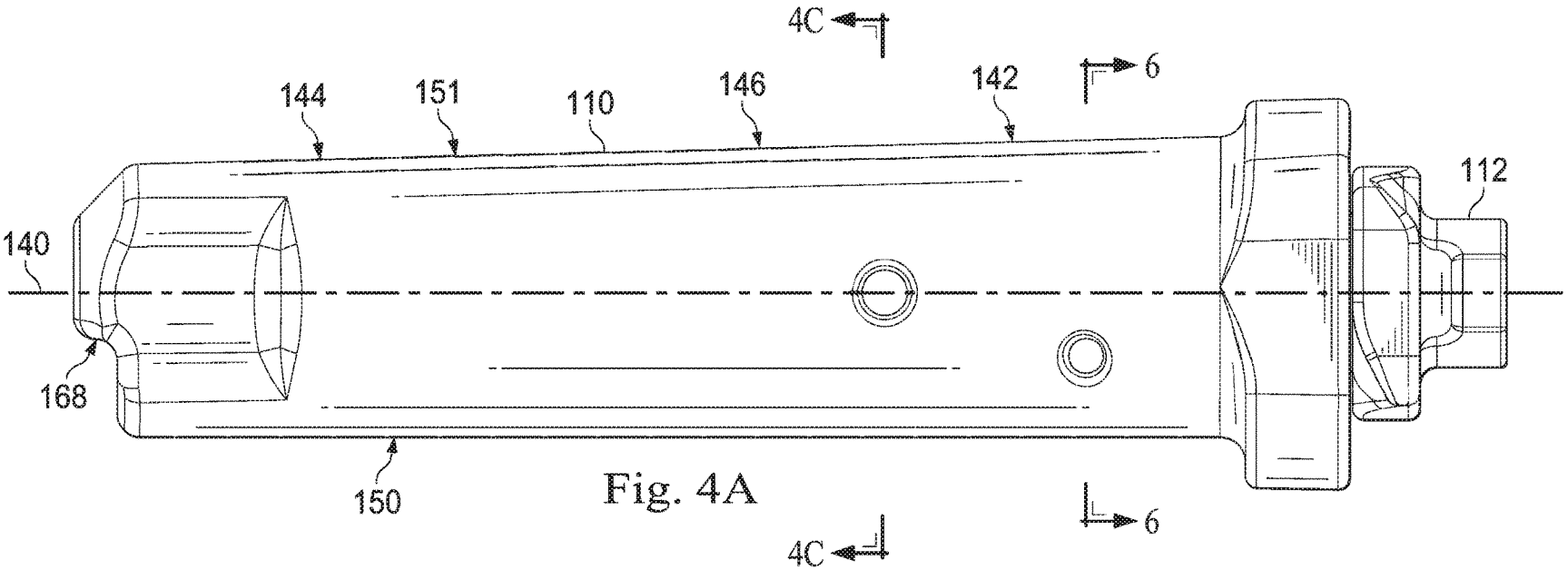
FIG. 4A is a top view of the locking pin assembly of FIG. 3A in an assembled configuration.
Figure 4B:
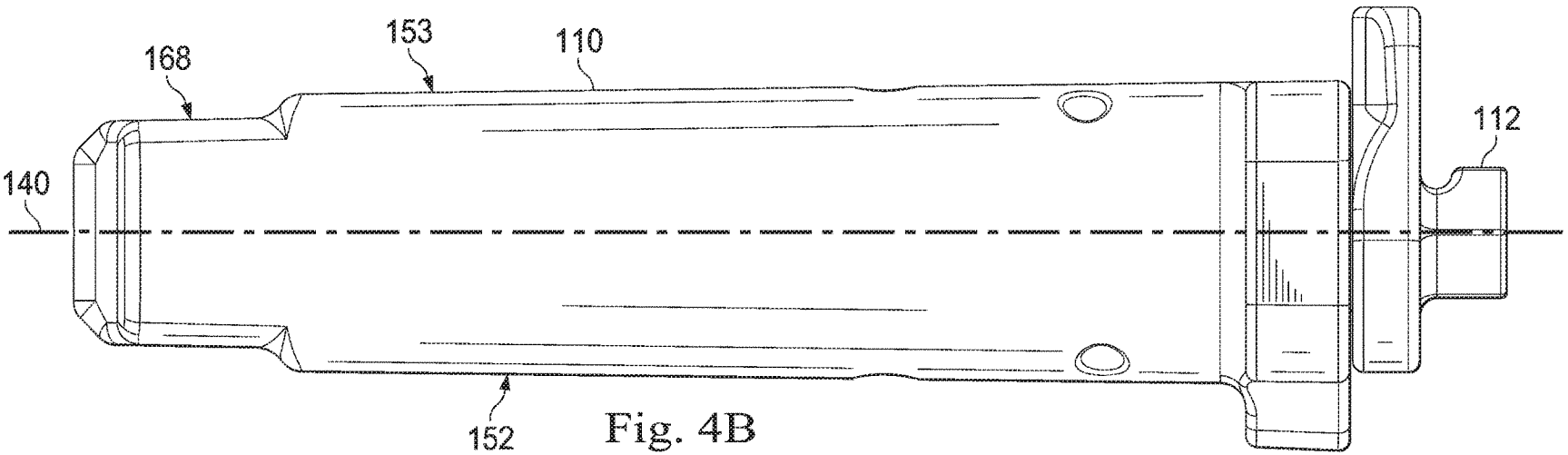
FIG. 4B is a front view of the locking pin assembly of FIG. 4A.
Figure 4C:
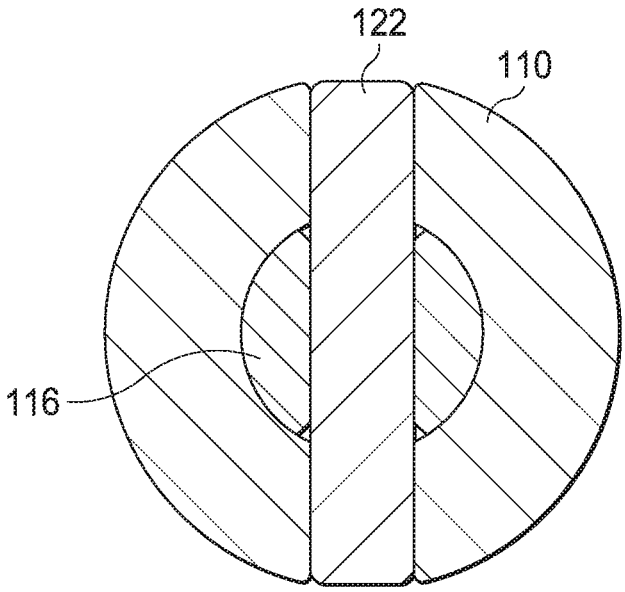
FIG. 4C is a cross-section view of the locking pin assembly of FIG. 4A.

Turning to FIGS. 4A and 4B, an assembled locking pin assembly 106 is shown in top view and front view, respectively. A reference axis 140 extends longitudinally through the center of the locking cavity 125, the shaft member 112, and the plunger 116. In the illustrated embodiment, the front side 150 of the body portion 110 may be defined by a portion of the outer surface 146 which extends parallel to the reference axis 140. This portion of the outer surface 146 may include an infinitesimally narrow line extending longitudinally across the front side 150 such that each transverse cross section through the body portion 110 is circular, as shown in FIG. 4C. In this regard, some or all of the circular cross-sections may be offset from the reference axis 140. Alternatively, the portion of the outer surface 146 parallel to the reference axis 140 may include a flat, surface, which may be planar, such that one or more of the cross-sections are D-shaped.

In contrast, each of the rear side 151, bottom side 152, and top side 153 may be defined by portions of the outer surface 146 which are not parallel to the reference axis 140. These sides 151, 152, 153 may include a taper extending from a proximal end 142 of the body portion 110 to a distal end 144 of the body portion 110. That is to say, the maximum outer diameter of the body portion 110, disregarding the head 124, is at the proximal end 142 and the minimum outer diameter of the body portion 110, disregarding the tip 168, is at the distal end 144. The tapered shape of the body portion 110 may improve the ease with which the locking pin assembly 106 may be removed from the bore 160. That is to say, due to the extreme compressive and torsional forces a locking pin assembly 106 may be subjected to during use, a body portion which is cylindrical may become wedged in the bore 160 and difficult to remove. However, a pin with a taper such as locking pin assembly 106 is more resistant to this problem. The taper between the maximum outer diameter and the minimum outer diameter may be linear or non-linear. Moreover, the taper on one or more of the sides 151, 152, 153 may be asymmetrical with respect to one or more other sides.

Figure 4D:
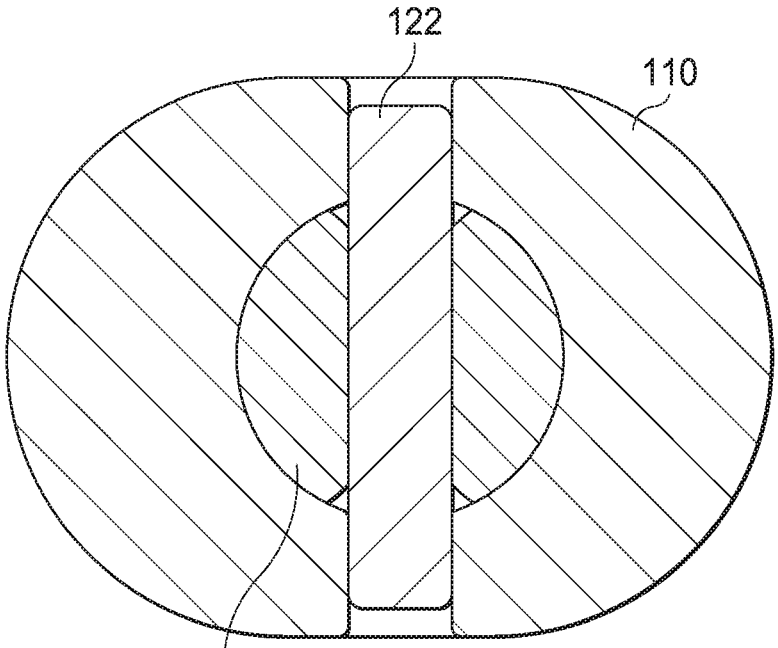
FIG. 4D is a cross-section view of an alternative locking pin assembly having an elongated profile.

The asymmetric design of body portion 110 may provide at least two advantages. First, if the bore 160 into or through the adapter 102 is similarly shaped to the outer surface 146 of the body portion 110, rotation of the locking pin assembly 106 may be prevented. In other words, a width of the body portion 110 from the front side 150 to the rear side 151 may exceed a height of the bore 160 if the bore is non-circular, and the body portion 110 will be unable to rotate when seated in the bore 160. This configuration can be seen, for example, in the alternative cross-section view of FIG. 4D.

Second, particularly in instances in which the portion of the outer surface 146 that is parallel to the reference axis 140 includes a planar surface, a load bearing capacity of the excavation tooth assembly 100 may be improved. That is to say, loading applied to the wear member 104 which is then transferred into the locking pin assembly 106 and the adapter 102 may cause excess wear or breakage in the locking pin assembly 106 and/or adapter 102 if the loading is not well-distributed. For example, a body portion which is tapered on all sides and which is installed in a cylindrical bore will experience greater loading near one end of the body portion than the other. However, by providing a surface on the body portion 110 which is parallel, rather than tapered, with respect to the reference axis 140, loading may be distributed evenly across the front side 150. It is also contemplated that, additionally or alternatively, a parallel portion may be provided at the rear side 151 of the outer surface 146 to distribute loading evenly during digging when the wear member 104 is pressed toward the rear of the adapter 102.

Figure 5A:
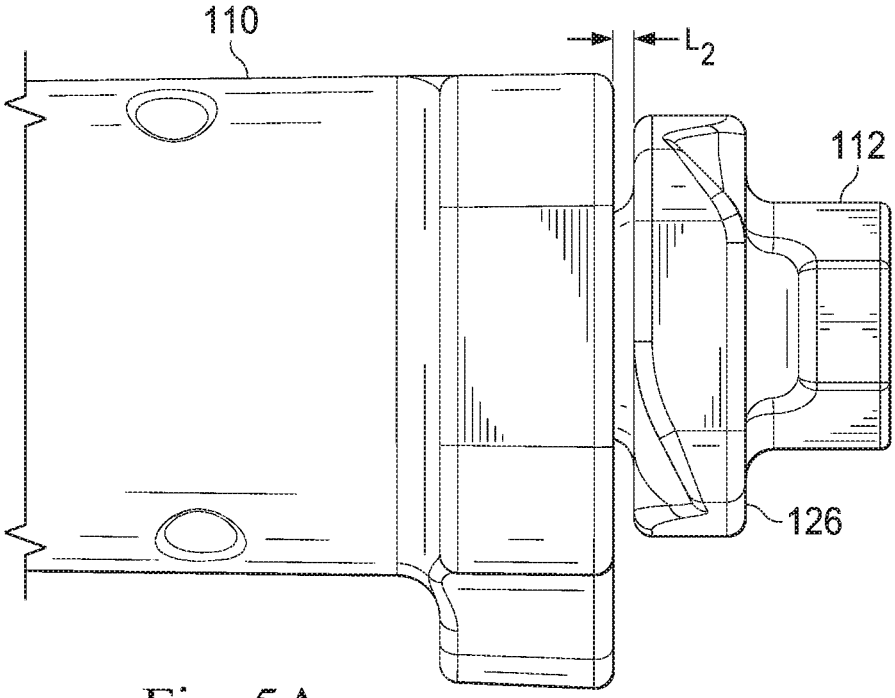
FIG. 5A is a partial side view of the locking pin assembly in an unlocked position.
Figure 5B:
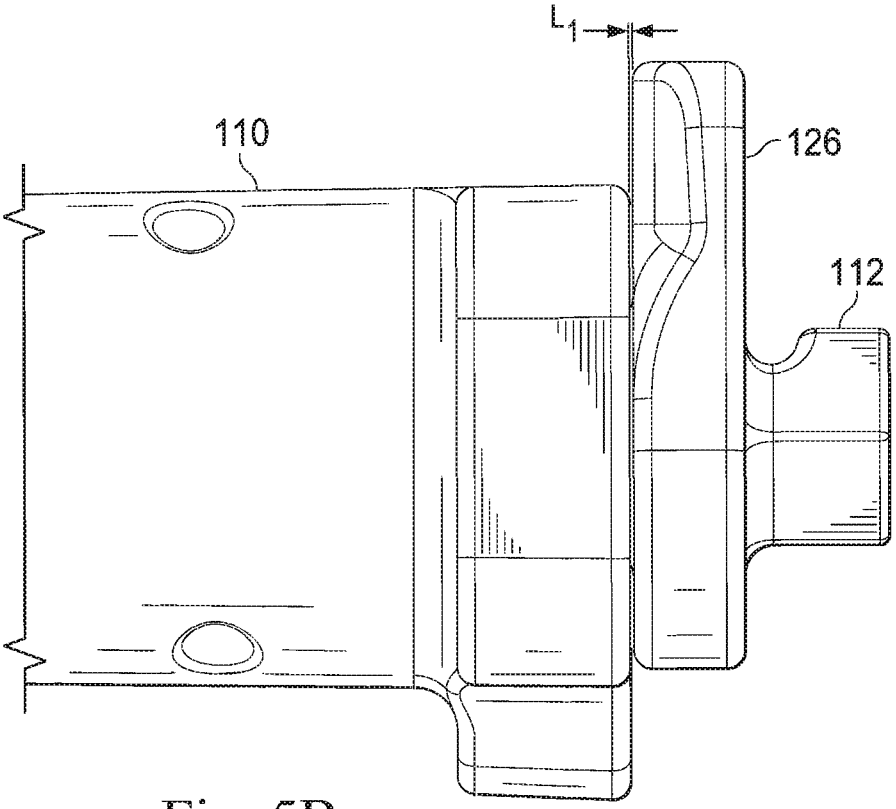
FIG. 5B is a partial side view of the locking pin assembly in a locked position.

Turning to FIGS. 5A and 5B, the shaft member 112 is shown in the unlocked configuration in FIG. 5A and in the locked configuration in FIG. 5B. As shown, the tang 126 may be separated from the head 124 of the body portion 110 by distance $L_2$ when the shaft member 112 is in the unlocked position. As the shaft member 112 is rotated to the locked position, the shaft member 112 may be axially displaced such that tang 126 is separated from the head 124 by distance $L_1$, which may be zero. This motion is facilitated by forming groove 130 (see FIG. 3A) with a slightly helical orientation. Thus, because the shaft dowel 120 remains stationary and fixed in place with respect to the body portion 110, rotation of the shaft member 112 causes the sides of the helical groove 130 formed in the shaft member 112 to push off from the shaft dowel 120, thereby axially displacing the shaft member 112. This feature may further contribute to providing haptic feedback to a user. Preferably, the width of the groove 130 matches a width of the shaft dowel 120 for a tight clearance fit. However, it is contemplated that a width of the groove 130 may be wider than the shaft dowel 120.

Figure 6:
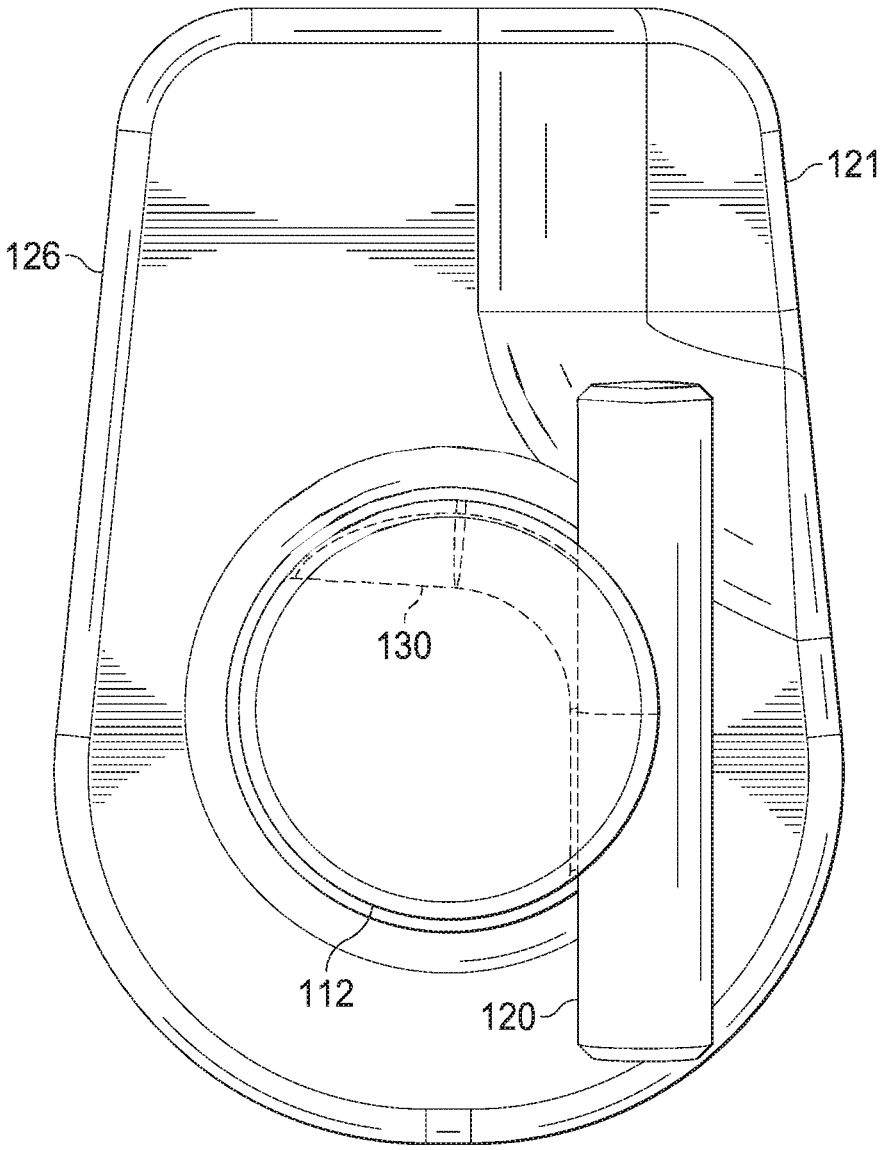
FIG. 6 is a cross-section view illustrating a rotation stopping element interacting with a groove in a shaft member according to the present disclosure.

FIG. 6 is a cross section, taken along line 6-6 in FIG. 4A, which further illustrates the interaction of groove 130 with the rotation stopping element, e.g., shaft dowel 120. Groove 130 may be partially circumferential, a length of which is limited and defined by opposing end portions of the groove 130. In turn, the limited length of the groove 130 limits the range of rotation of the shaft member 112. In this regard, the shaft dowel 120 which is positioned in the dowel recess 121 may mechanically interfere with rotation of the shaft member 112 by contacting the end portions of the groove 130 as the shaft member 112 is rotated, preventing further rotation. In the illustrated embodiment, the groove 130 is configured to have an arc length which permits approximately 90 degrees of rotation, which corresponds to the 90 degrees of rotation facilitated by the four equidistant teeth on the shaft member 112 and the plunger 116. This 90 degree range of rotation is sufficient to transition the tang 126 from the unlocked position to the locked position, and vice versa. However, the groove 130 may be configured to any length to facilitate any desired range of motion.

Figure 7:
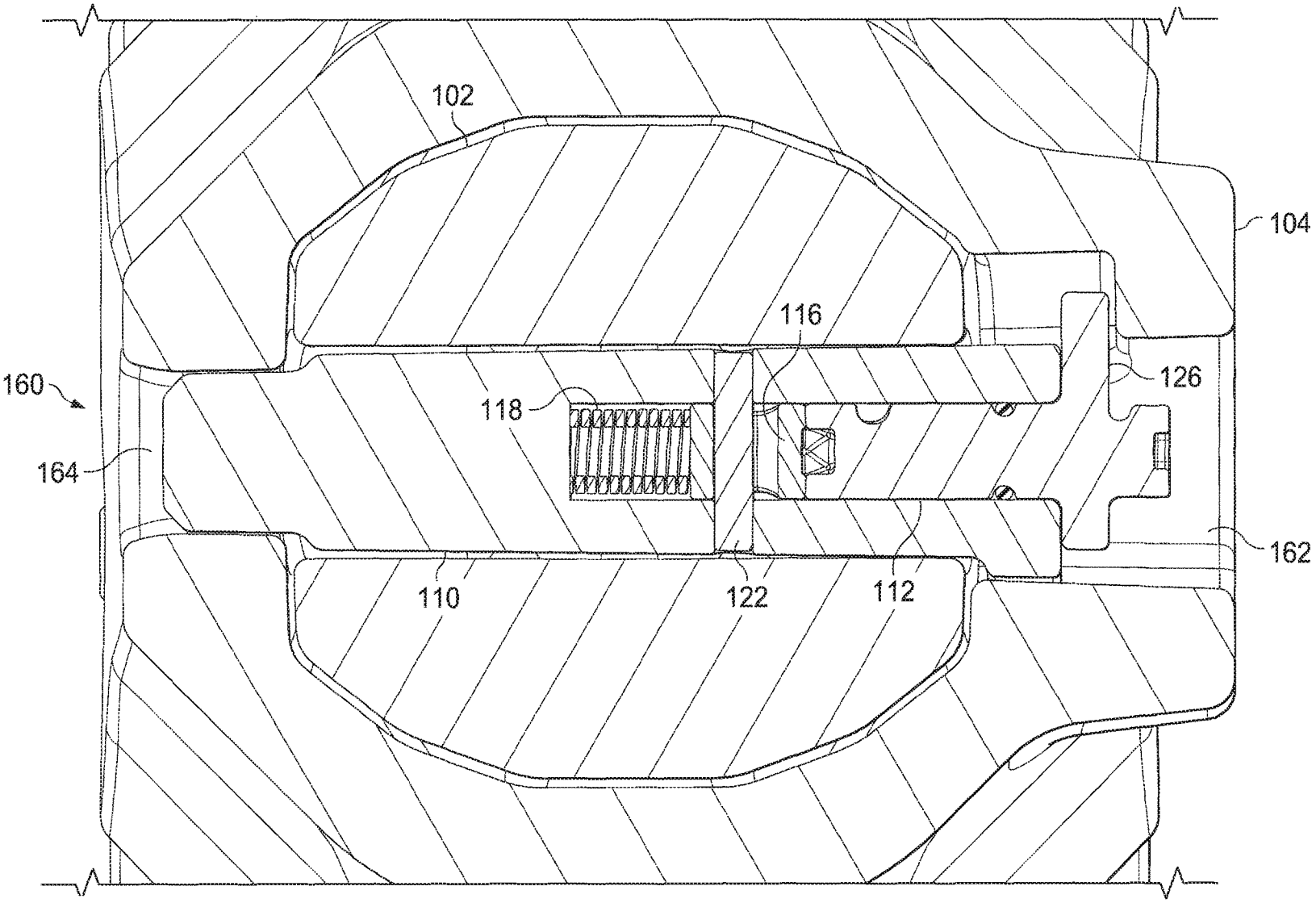
FIG. 7 is a front cross-section view of the assembly of FIG. 1.
Figure 8:
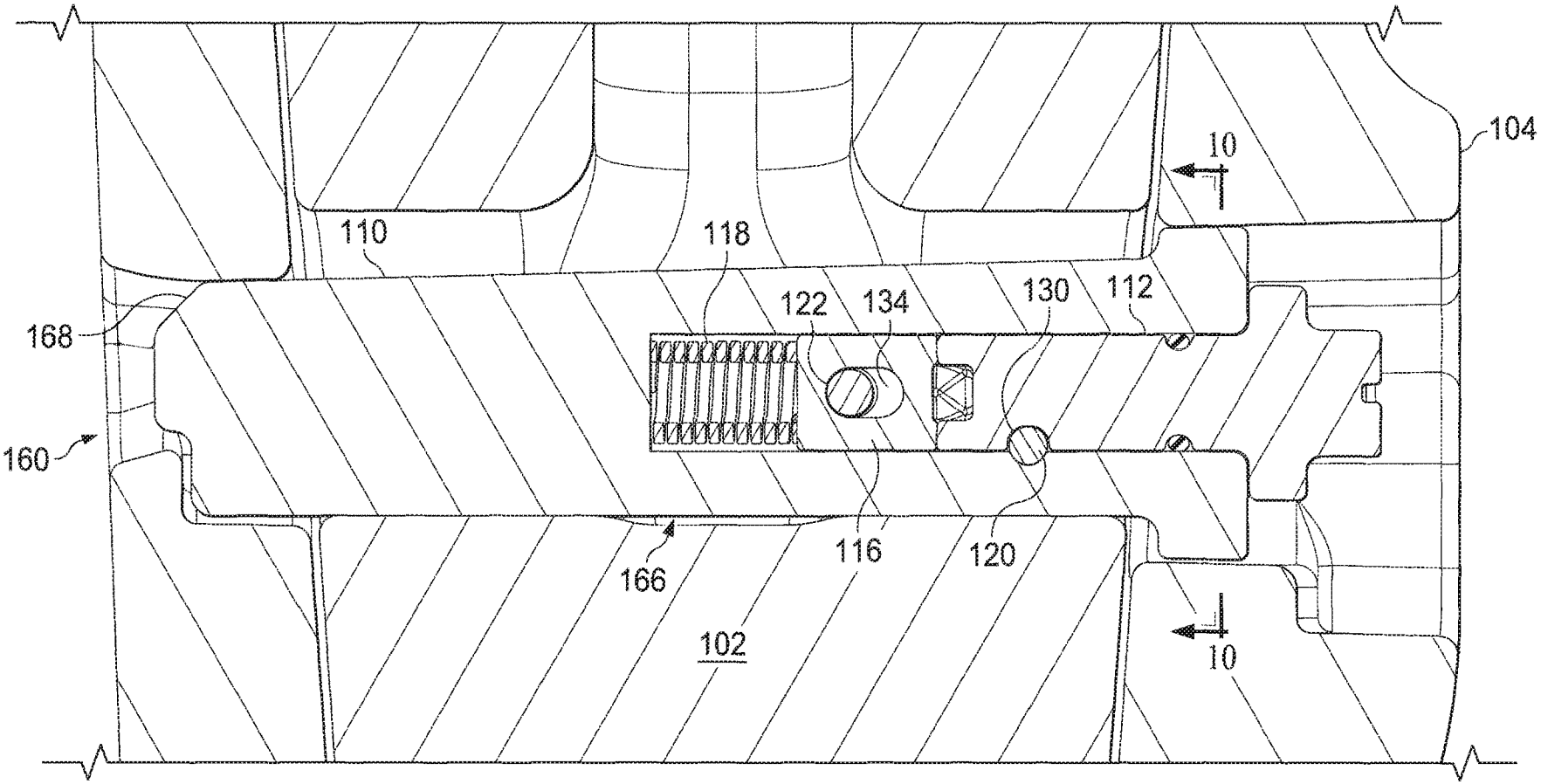
FIG. 8 is a top cross-section view of the assembly of FIG. 1.
Figure 9:
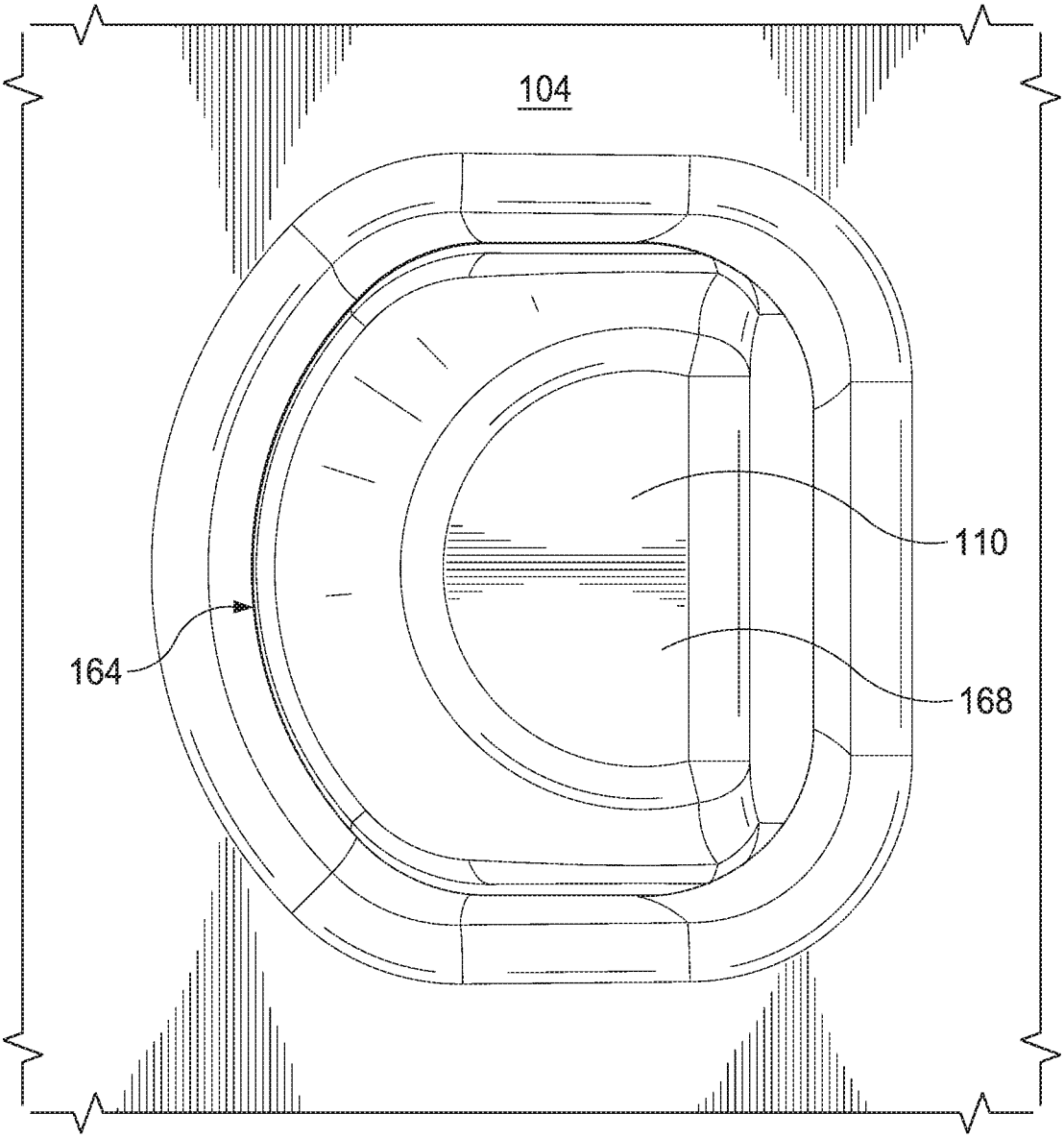
FIG. 9 is a partial left side view of the assembly of FIG. 1, illustrating the interaction of a locking pin assembly with a wear member.
Figure 10:
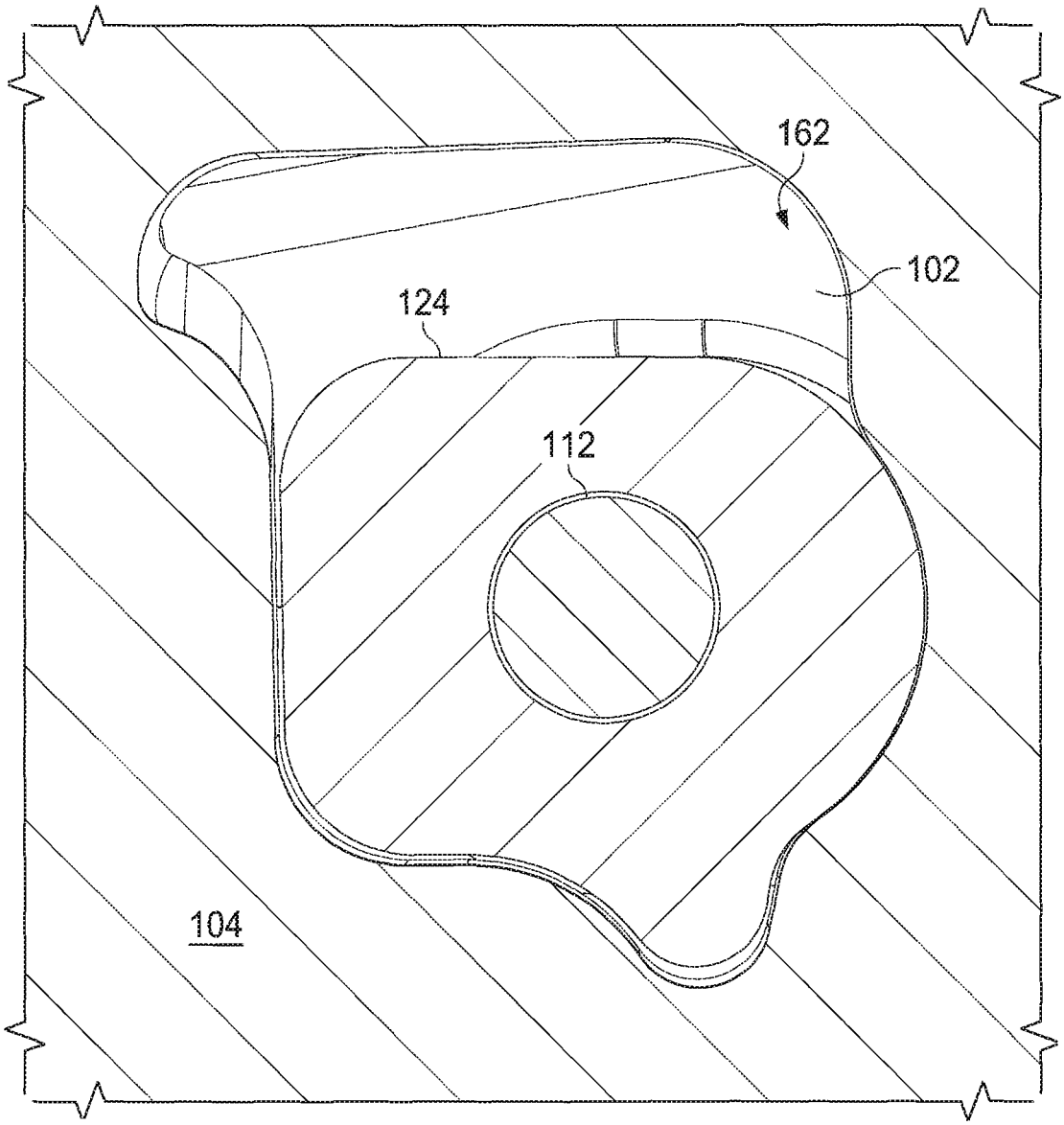
FIG. 10 is a right side cross-section view of the assembly of FIG. 1, illustrating the interaction of a locking pin assembly with a wear member.

Turning to FIGS. 7-10, FIGS. 7 and 8 illustrate a front cross section view taken along line 7-7 and top cross section view taken along line 8-8, respectively, of the excavating tooth assembly of FIG. 1. FIG. 9 illustrates a left side view of the bore 160 of the excavating tooth assembly and FIG. 10 illustrates a cross section view taken along line 10-10 of FIG. 8.

The bore 160 extends through the wear member 104 and the adapter 102 from a proximal opening 162 in a first wall of the wear member 104 to a distal opening 164 in an opposing second wall of the wear member 104. However, as discussed above, the bore 160 may alternatively not pass all the way through the adapter 102 but may only extend partially into the adapter 102, in which case shorter locking pin assemblies may be provided which correspond to a short bore length.

As best shown in FIGS. 8-10, the body portion 110, specifically the head 124, may be sized and shaped to mechanically interface with the proximal opening 162 at the proximal end of the body portion, and the body portion 110, specifically the tip 168, may be sized and shaped to mechanically interface with the distal opening 164. Accordingly, the body portion 110 has a non-circular peripheral profile or shape, at least at these locations, that prevents rotation of the body portion 110 relative to the wear member 104. Moreover, the snug fit between the body portion 110 and the proximal and distal openings 162, 164 causes the locking pin assembly 106 to move in unison with the wear member 104. Advantageously, this may prevent the wear member 104 from exerting a force on the tang 126, which could undesirably unlock it, as the wear member 104 moves with respect to the adapter 102 during use.

As best shown in FIG. 10, the proximal opening 162 may have an asymmetric profile, with at least a portion which is non-circular. In this regard, the asymmetric shape may assist a user with inserting the locking pin assembly 106 into the bore 160 in the correct orientation. That is, a symmetrical head may result in a user attempting to insert the locking pin assembly inverted, which may lead to improper load distribution across the body portion by positioning the portion of the outer surface which is parallel to the reference axis 140 in the wrong region of the bore 160. Moreover, the non-circular portions of the profile of the head 124 allow the head 124 to be seated tightly within at least a portion of the proximal opening 162 in a manner which prevents rotation of the locking pin assembly 106 with respect to the wear member 104.

As shown in FIG. 8, a load bearing surface 166 may be provided in portion of the bore 160 passing through the adapter 102. This load bearing surface may be sized and shaped to closely correspond to the front side 150 of outer surface 146 of the body portion 110, which may be parallel to the reference axis 140 as described above in relation to FIG. 4A. Although the adapter 102 is preferably designed to handle loading exerted by the wear member 104 and locking pin assembly 106 in all directions, the load bearing surface 166 may be specifically adapted to ensure even distribution of loading across the body portion 110.

Distal opening 164 is sized to be smaller than the diameter of a portion of the body portion 110 to prevent the locking pin assembly 106 from sliding out the distal end of the bore 160 and to ensure the locking pin assembly 106 does not become seated so deeply within the bore 160 that it becomes wedged and cannot easily be removed. Although in alternative embodiments, the distal opening 164 may be replaced with a distal recess on an interior wall of the wear member 104 rather than passing all the way through the wall, in the illustrated embodiment the distal opening 164 is provided as an access point for a tool, such as a punch, to dislodge the locking pin assembly 106 should it become stuck in the bore 160. The tip 168 may extend well into distal opening 164 to allow a user to easily access the body portion 110 if it does become stuck.

In FIGS. 7 and 8, the tang 126 is in the locked position such that the locking pin assembly is secured within the bore 160 due to mechanical interference of the wall of the wear member 104 above proximal opening 162 and the tang 126. The positioning of the tang 126 with respect to features of the wall of the wear member 104 are discussed in more detail below in relation to FIGS. 12-15.

As was described above in relation to FIG. 3, FIG. 8 provides an additional view of the plunger dowel 122 and elongated aperture 134 through which it is disposed, as well as the shaft dowel 120 and its location with respect to the shaft member 112 and groove 130.

Figure 11:
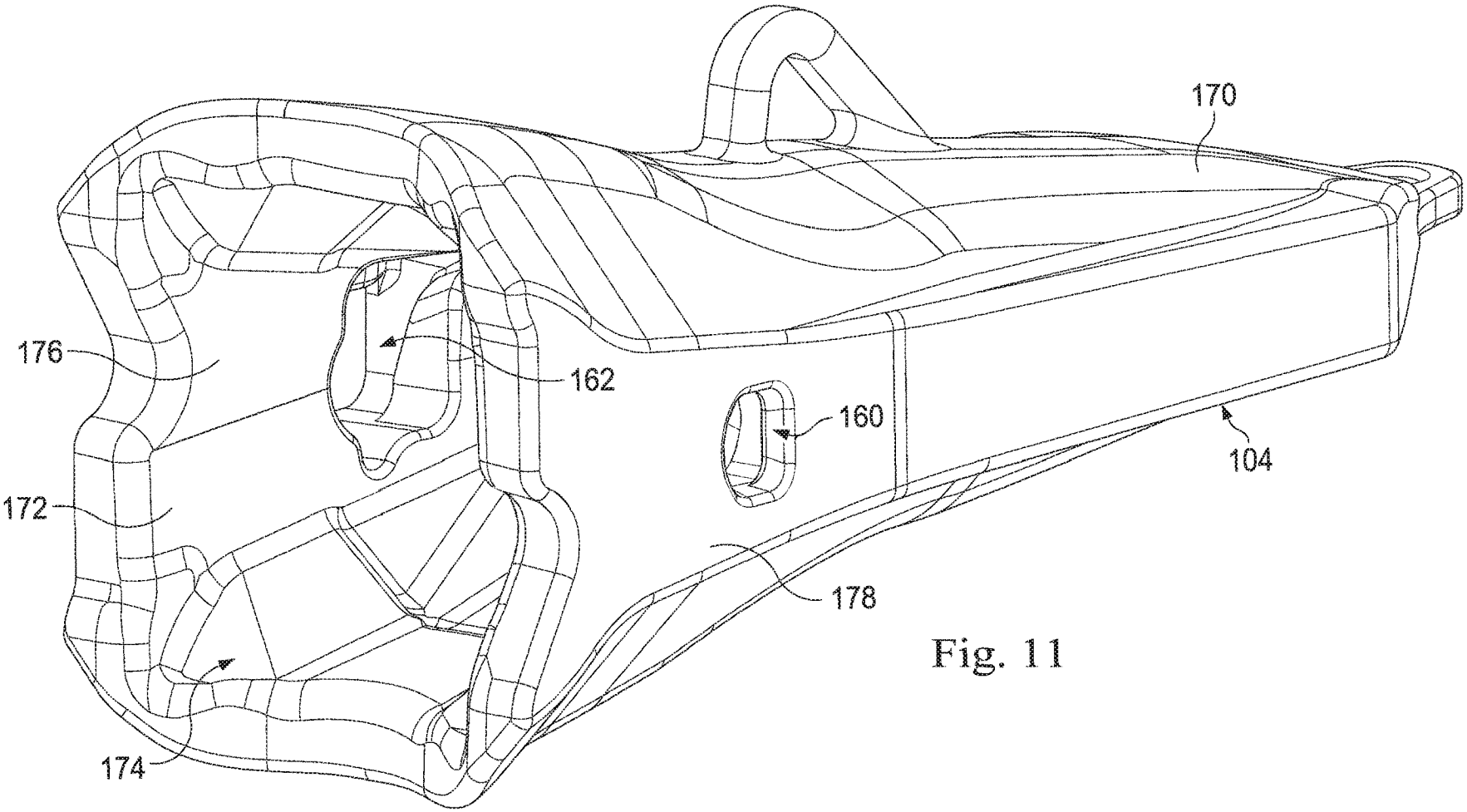
FIG. 11 is a right side perspective view of a wear member embodying principles of the present disclosure.
Figure 12:
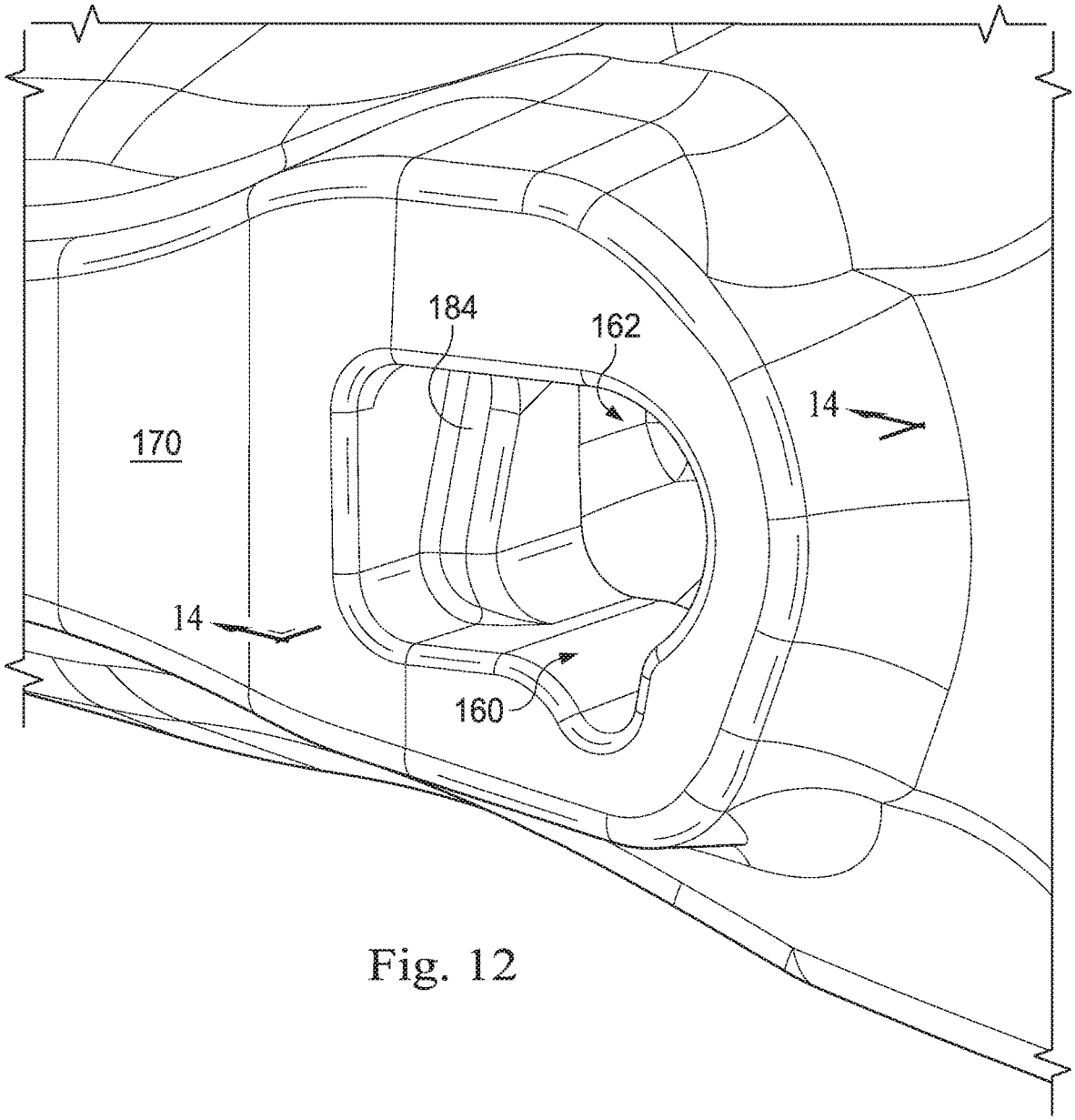
FIG. 12 is a is a partial left side perspective view of the wear member of FIG. 11, illustrating a proximal opening of a bore through the wear member.
Figure 13:
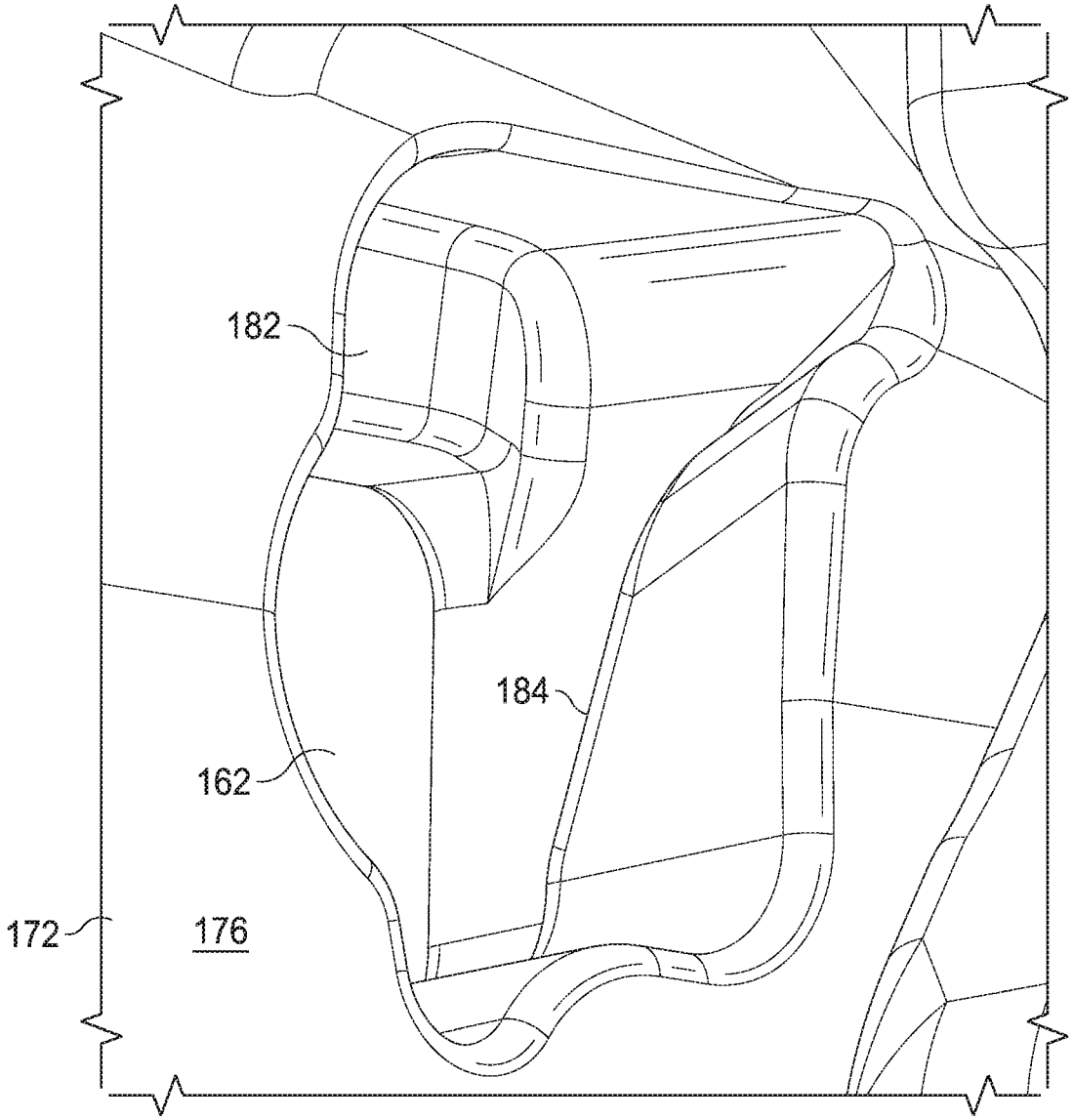
FIG. 13 is a perspective view of the proximal opening of FIG. 12, viewed from inside the cavity of the wear member.
Figure 14:
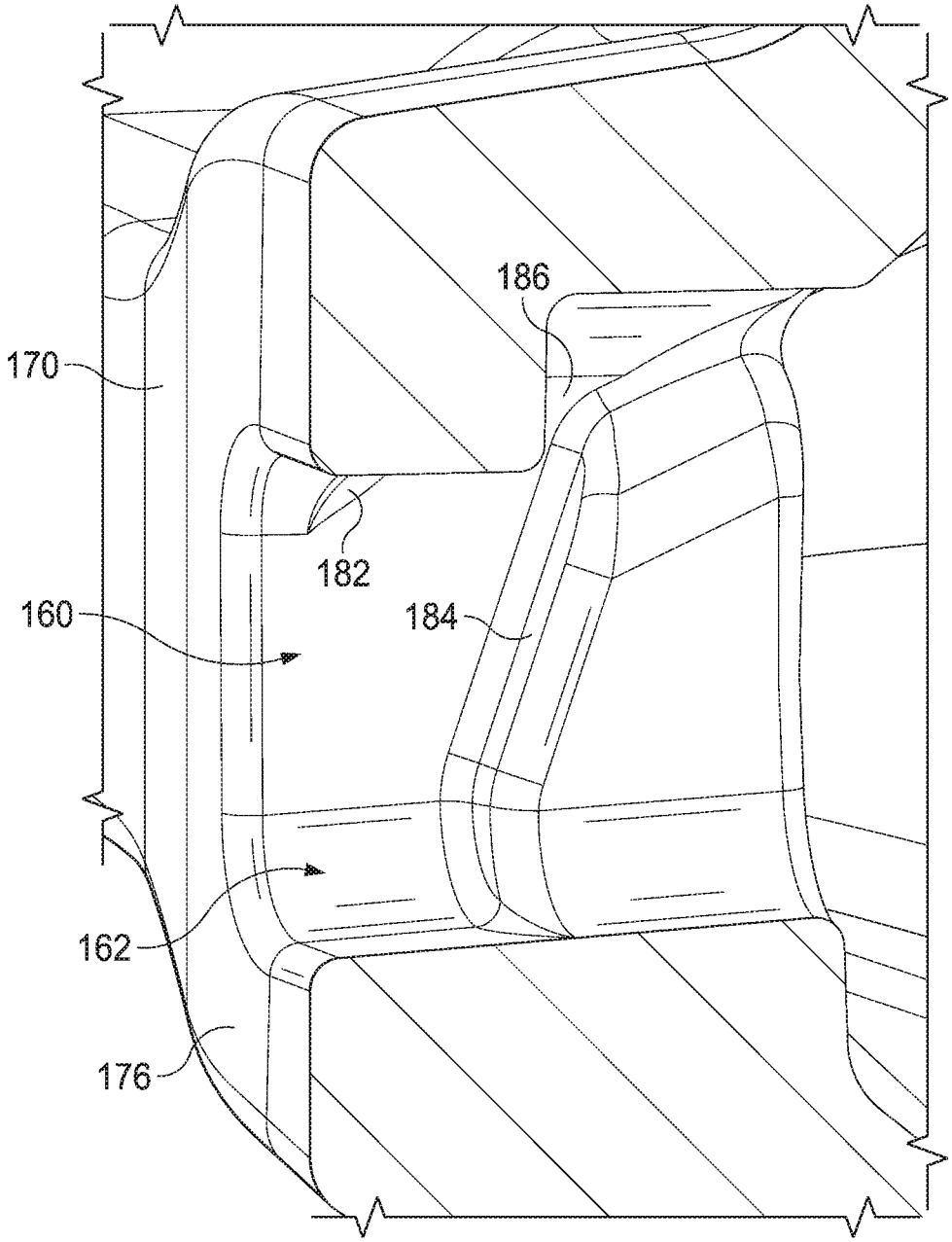
FIG. 14 is a cross section view of the proximal opening of FIG. 12.
Figure 15:
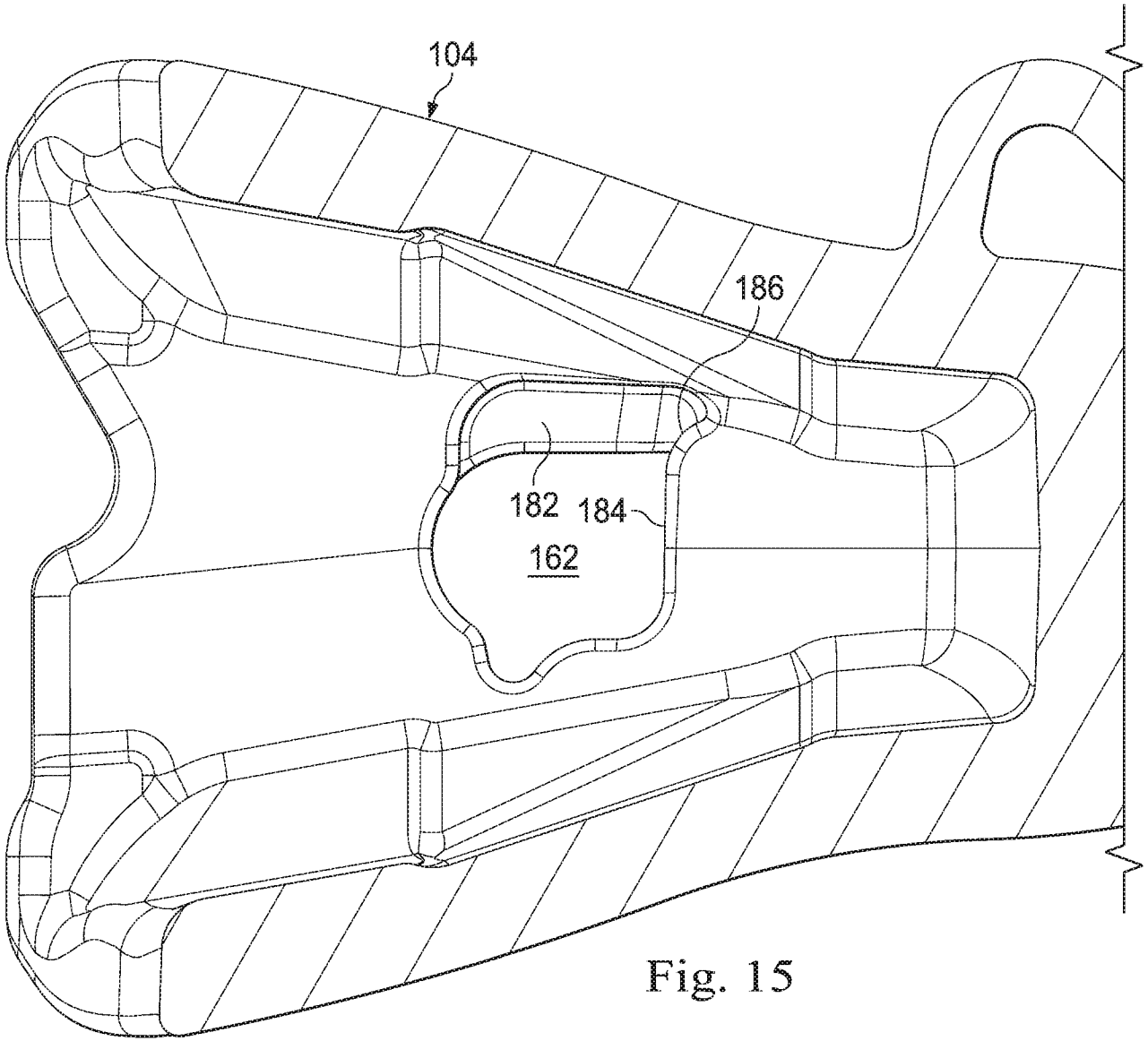
FIG. 15 is a right side cross section view through the cavity of the wear member of FIG. 12, illustrating the proximal opening of FIG. 12.

FIGS. 11-15 provide various illustrations of wear member 104 with particular attention to features associated with proximal opening 162 of bore 160. FIG. 11 is a right side perspective view of a wear member. FIG. 12 is a is a partial left side perspective view of the proximal opening of the wear member. FIG. 13 is a perspective view of the proximal opening of FIG. 12, viewed from inside the cavity of the wear member. FIG. 14 is a cross section view of the proximal opening and FIG. 15 is a right side cross section view through the cavity of the wear member.

The wear member 104 includes an external surface 170 and an internal surface 172. The internal surface 172 defines a cavity 174 into which the adapter 102 may be inserted. The wear member 104 is comprised of a first wall 176 and a second wall 178 opposite the first wall. The bore 160 extends through both the first wall 176 and the second wall 178 from the proximal opening 162 to the distal opening 164.

As best seen in FIG. 12, in the illustrated embodiment, the proximal opening 162 has a profile at the external surface 170 of the wear member 104 which is substantially D-shaped. The flat wall of the D-shape engages a similar flat surface of the head 124 which provides for resistance to rotation. The proximal opening 162 further has a lobe extending into the first wall 176 at a portion of its perimeter which is remote from the flat wall. This lobe may further ensure the head 124 is inserted in the correct orientation and does not rotate with respect to the wear member 104.

Within the first wall 176 are two sloped surfaces intended to aid in the installation and removal of the locking pin assembly 106. An installation ramp 182 is configured for engagement with the proximal side of the tang 126 as it is rotated from the unlocked position to the locked position. The installation ramp 182 may be disposed in a proximal region of the first wall 176. As the tang 126 is rotated toward the locked position, it slides across the installation ramp 182 which is angled into the bore 160. In this regard, rotation of the shaft member 112 is translated into axial movement by the tang 126 sliding across the installation ramp 182, forcing the locking pin assembly 106 into a seated position within the bore 160. The last portion of travel of the tang 126 during rotation into the locked position may correspond to a portion of the installation ramp 182 which is flat, rather than ramped, and oriented transverse to the bore 160. This transverse end portion of the installation ramp 182 may extend over approximately 5-30 degrees of rotation and may correspond to a fully seated condition of the locking pin assembly 106. That is, the tang 126 may only reach the transverse end portion if and when the locking pin assembly 106 is fully inserted into the bore 160. In the illustrated embodiment, the tang 126 does not engage the installation ramp 182 until it has reached approximately 45 degrees of rotation. In this regard, as a user rotates the tang 126 90 degrees from the unlocked position to the locked position, the tang may rotate without engagement during the first 45 degrees of rotation. At that point, the proximal side of the tang 126 may engage and begin to slide across the installation ramp 182. It should be appreciated that the installation ramp 182 may extend across only a small portion (e.g., 5 degrees) of the range of rotation of the tang 126 or may extend across the entire range of rotation of the tang 126.

Due to the orientation of the installation ramp 182, as the tang 126 slides across the installation ramp 182, the locking pin assembly 106 is urged further into the bore 160 until it reaches a fully seated condition. At that point, the tang 126 may be rotated another 5-25 degrees across the transverse portion of the installation ramp 182 until the tang 126 is vertical. At this point, the tang 126 may contact an interior wall of the wear member 104 which prevents the tang 126 from being over-rotated beyond the preferred positioning. Positioning the tang 126 at rest on the transverse end portion of the installation ramp 182, which is perpendicular to the direction of removal of the locking pin assembly 106 from the bore 160, may aid in retaining the locking pin assembly 106 in the bore 160.

Disposed adjacent to the installation ramp 182 is a removal ramp 184. The removal ramp 184 may function in a similar manner as the installation ramp 182, but may engage the distal side of the tang 126 as it is rotated from the locked position to the unlocked position. That is, with the locking pin assembly 106 in the fully seated condition, the shaft member 112 may be rotated from the locked position to the unlocked position. Initially, the tang 126 may travel over a range of rotation without contacting the removal ramp 184. At some point during the rotation from the locked position to the unlocked position, for example at approximately 10-70 degrees into the 90 degree rotation, the tang 126 may engage the removal ramp 184 which interfaces with the distal side of the tang 126 to urge the locking pin assembly 106 out of the bore 160. This may be particularly advantageous for removal when debris or stresses have lodged the locking pin assembly 106 in the bore 160.

In some embodiments, the slope of the installation ramp 182 and the slope of the removal ramp 184 may be different, or may be different at specific positions along the range of rotation of the tang 126. "Slope" as used with reference to the installation ramp 182 and removal ramp 184 refers to a magnitude of axial displacement of the tang 126 caused by the tang 126 travelling over a specified distance of the respective ramp. That is, a greater slope refers to an orientation of a surface of a ramp which causes greater axial displacement of the locking pin assembly 106 than a lesser slope. For example, the transverse end portion of the installation ramp may effectively have a slope of zero. In the illustrated embodiment, the installation ramp 182 may have a lesser slope than the removal ramp 184. In some embodiments, the difference in slope may correspond to a difference in length of the ramps. For example, a long installation ramp 182 may have a lesser slope to distribute the axial displacement of the locking pin assembly 106 across a greater distance. In contrast, the removal ramp 184 may desirably have a greater slope to aid in removing the locking pin assembly 106 if it has become wedged due to debris or deformation.

As illustrated, a gap 186 may be disposed between a portion of the installation ramp 182 and a portion of the removal ramp 184. The gap 186 is sized to allow the tang 126 to pass through the gap 186 during rotation. It should be appreciated that the removal ramp 184 does not extend across the whole range of rotation of the tang 126 but rather, in some implementations, overlaps installation ramp 182 over only a small portion of their respective ranges of rotation. This feature may advantageously allow the tang 126 to rotate to a position at which it is clear from being obstructed from removal by the portion of the first wall 176 which includes the installation ramp 182 before the tang 126 engages the removal ramp 184 and begins to push outward through the proximal opening 162. The overlap of the installation ramp and the removal ramp (when such overlapping is present) may permit the gap 186 to be present in a direction substantially parallel to a longitudinal axis of the proximal opening 162.

Figure 16:
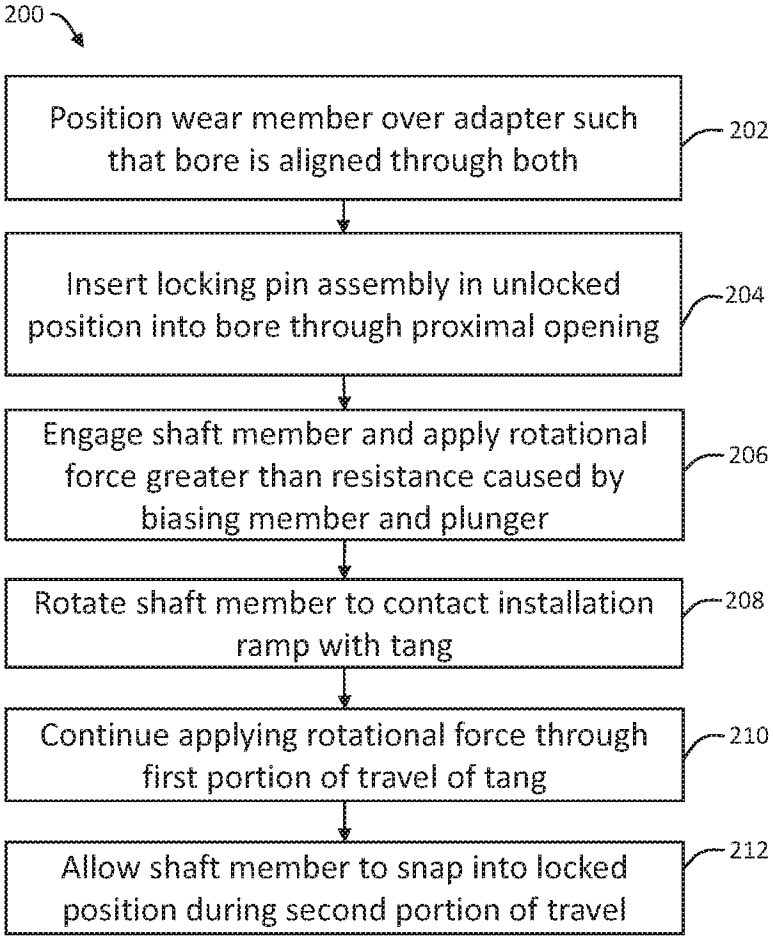
FIG. 16 is a flow chart of a method for securing a wear member on an adapter with a locking pin assembly according to the present disclosure.

FIG. 16 illustrates a method 200 for securing a wear member to an adapter using a locking pin assembly of the present disclosure. It should be appreciated that although described in the context of a wear member and an adapter, the method may also be applicable for securing an intermediate adapter to an adapter or a wear member to an intermediate component. The method may include the process 202 of positioning a wear member over an adapter such that a bore is aligned through both the wear member and the adapter. In some embodiments, the bore may only pass through a portion of the adapter and in other embodiments the bore may pass completely through the wear member and the adapter.

The method may include a process 204 of inserting a locking pin assembly in an unlocked position into the bore through a proximal opening of the bore in the wear member. Having the locking pin assembly in the unlocked position ensures the tang will clear the wall surfaces of the proximal opening, allowing the locking pin assembly to be inserted. The method may further include a process 206 of engaging the shaft member, typically via the tool engagement feature using a tool operated by a user, and applying a rotational force in a direction which urges the shaft member toward the locked position. The method may include the process 208 of rotating the shaft member as the tang contacts an installation ramp disposed in or adjacent to the bore. As rotation of the tang continues, the rotation may be translated into axial displacement of the locking pin assembly to seat the locking pin assembly in a desired position in the bore.

The method may further include a process 210 of first rotating the shaft member of the locking pin assembly relative to a body portion of the locking pin assembly in a first direction through a first range of motion in which resistance is provided, and in some embodiments increases, by a first engagement feature of the shaft member interacting with a second engagement feature of the plunger. For example, a first surface of a tooth of the shaft member may engage a corresponding first surface of a notch of a plunger disposed within the body portion while the plunger is substantially rotationally fixed with respect to the body portion and rotation of the shaft member through the first range of motion axially displaces the plunger toward a biasing member from an initial position to a compressed position, thereby providing a resistance to rotation.

The method may further include a process 212 of second rotating the shaft member relative to the body portion in the first direction through a second range of motion. During the second range of motion, the first and second engagement features may temporarily disengage or engage in a manner which substantially reduces the resistance provided. For example, a second surface of the tooth may slide relative to a corresponding second surface of the notch during rotation of the shaft through the second range of motion, and the biasing member may return the plunger to the initial position. During the second rotating, a user may continue applying rotational force in the first direction, or may simply allow the first and second engagement features to snap the tang into the locked position in which a portion of a wall of the wear member interferes with axial displacement of the tang in a direction associated with withdrawing the locking pin assembly from the bore.

In an exemplary embodiment, the rotation between the unlocked and locked positions may cover approximately 90 degrees. The first range of motion may include a range between 10 and 80 degrees and the second range of motion may include a range between 10 and 80 degrees. In a preferred embodiment, the first range of motion and the second range of motion each includes about 45 degrees.

Figure 17:
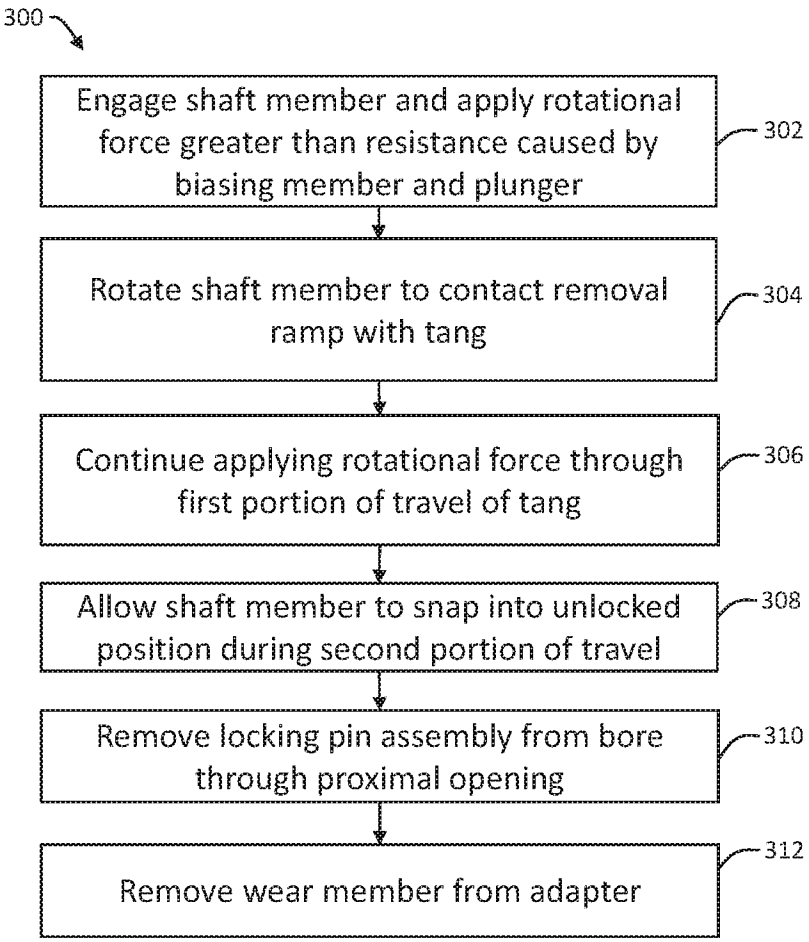
FIG. 17 is a flow chart of a method for removing a wear member secured with a locking pin assembly from an adapter.

Turning to FIG. 17, a method 300 for removing a wear member from an adapter to which the wear member is secured with a locking pin is illustrated. The method may include a process 302 of engaging a shaft member, for example with a tool, and applying a rotational force greater than a resistance caused by the biasing member and plunger interfering with rotation of the shaft member. The rotational force may be applied in a direction tending to move the tang from the locked position to the unlocked position. A process 304 of rotating the shaft member as it contacts and slide s with respect to a removal ramp may be included. This interaction between the tang and the removal ramp may translate rotation of the shaft member into axial displacement of the locking pin assembly in a direction of removal from the bore.

The method further includes a process 306 of continuing to apply rotational force through a first portion of travel of the tang. During the first portion of travel, the first engagement feature and second engagement feature may interact to continue providing resistance to the rotation. In some embodiments, the resistance may increase during the first portion of travel. The method may also include a process 308 of allowing the shaft member to snap to the unlocked position during a second portion of travel in which no resistance to rotation is provided, and in fact such rotation may be urged as the plunger is pushed back into its initial position by the biasing member.

With the tang in the unlocked position, a process 310 of the method may include removing the locking pin assembly from the bore through the proximal opening. The method may further include a process 312 of removing the wear member from the adapter.

In a preferred embodiment, the first and second portions of travel may each include about a 45 degree range of rotation.

The ranges of motion described herein are intended only to be exemplary for the purpose of describing the illustrated embodiment. One of ordinary skill in the art should appreciate that the various ranges of motion may be increased or decreased for a desired implementation. For example, the range of rotation of a tang between locked and unlocked positions may be substantially greater than or substantially less than 90 degrees. The proximal opening of a bore may be geometrically reconfigured accordingly, including an installation ramp and/or a removal ramp which may need to extend over a greater or lesser distance to achieve a desired level of axial displacement of the locking pin assembly during the rotation.

The locking pin assembly described herein may provide advantages and benefits not found in conventional devices. For example, it may be more resistant to inadvertent unlocking, wedging in the bore, and damage from loading than some conventional pin assemblies. While described with reference to a wear member and an adapter, it should be understood that the locking pin assembly may find use in other applications. For example and without limitation, the locking pin assembly may be used to attach an adapter to a bucket or other structures in the ground engaging tool industry.

Persons of ordinary skill in the art will appreciate that the implementations encompassed by the present disclosure are not limited to the particular exemplary implementations described above. In that regard, although illustrative implementations have been shown and described, a wide range of modification, change, combination, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

What is claimed is:

1. A locking pin assembly for securing a ground engaging member to a support structure, comprising:

a body portion arranged to non-rotatably, selectively project into an opening in the support structure, the body portion having an opening formed therein;

a shaft member comprising a distal end and a proximal portion, the distal end having a first engagement feature, and the distal end being disposed within the body portion;

a tang extending radially from the proximal portion of the shaft member outside the body portion, the shaft member being rotatable relative to the body portion between a first position in which the tang is positionable to mechanically inhibit removal of the locking pin assembly from the ground engaging member when positioned to secure the ground engaging member to the support structure and a second position in which the tang is positionable to permit removal of the locking pin assembly from the ground engaging member when positioned to secure the ground engaging member to the support structure;

a biasing member disposed within the body portion; and a plunger disposed between the biasing member and the distal end of the shaft member, the plunger comprising a second engagement feature configured to selectably engage the first engagement feature of the shaft member, wherein the biasing member urges the plunger toward the shaft member and the second engagement feature is configured to engage the first engagement feature to provide resistance during rotation of the shaft member relative to the plunger in each of two opposing directions.

2. The locking pin assembly of claim 1, wherein the first engagement feature and the second engagement feature are configured to rotate relative to one another when a rotational force applied to the shaft member exceeds a magnitude of the resistance to rotation exerted by the biasing member to rotate the shaft member from one of the first position and the second position to the other of the first position and the second position.

3. The locking pin assembly of claim 2, wherein the first engagement feature, the second engagement feature, and the biasing member are configured so that the resistance to rotation exerted by the biasing member occurs during a first portion of rotational travel and does not occur during a second portion of rotational travel.

4. The locking pin assembly of claim 3, wherein one of the first and second engagement features comprises two adjacent notches separated by a resistance peak, and the other of the first and second engagement features comprises a tooth configured to selectably seat within each of the two notches.

5. The locking pin assembly of claim 4, wherein the resistance peak comprises a planar surface extending between a first angled surface and a second angled surface, the first and second angled surfaces defining opposing sides of the one of the first and second engagement features.

6. The locking pin assembly of claim 5, wherein the first and second angled surfaces are angled with respect to a direction of rotation of the shaft member in a range of about 60° to 80°.

7. The locking pin assembly of claim 4, wherein the resistance peak is disposed approximately midway between the two adjacent notches.

8. The locking pin assembly of claim 7, wherein the two adjacent notches are centered approximately 90 degrees apart.

9. The locking pin assembly of claim 8, wherein the other of the first and second engagement features comprises a third notch, and wherein the resistance peak is sized and shaped to fit within the third notch when the tooth is seated within one of the two adjacent notches.

10. The locking pin assembly of claim 8, wherein the first engagement feature, the second engagement feature, and the biasing member are configured so that rotation of the shaft member between the two adjacent notches provides haptic feedback to a user confirming transition from the first position to the second position.

11. The locking pin assembly of claim 10, wherein the first engagement feature, the second engagement feature, and the biasing member are configured so that rotation of the shaft member between the two adjacent notches provides haptic feedback to a user confirming transition from the second position to the first position.

12. The locking pin assembly of claim 1, further comprising a rotation stopping element, and wherein the shaft member comprises a partially circumferential groove formed therein, and the rotation stopping element configured to mechanically interfere with opposing end portions of the groove to limit a range of rotation of the shaft member relative to the body portion.

13. The locking pin assembly of claim 12, wherein the groove extends helically such that engagement of the rotation stopping element with the groove translates rotation of the shaft member into axial displacement of the shaft member with respect to the body portion.

14. The locking pin assembly of claim 13, wherein the rotation stopping element interfering with the end portions limits rotation of the shaft member in a range of about 90 degrees relative to the body portion.

15. The locking pin assembly of claim 14, wherein the rotation stopping element comprises a dowel extending through a portion of the body portion.

16. The locking pin assembly of claim 1, further comprising:

a second rotation stopping element extending from the plunger and configured to prevent rotation of the plunger while permitting axial displacement of the plunger.

17. The locking pin assembly of claim 16, wherein the second rotation stopping element comprises a second dowel fixed in relation to the body portion, and wherein the plunger comprises an elongated recess into which the second dowel extends.

18. The locking pin assembly of claim 16, wherein the second rotation stopping element comprises a protrusion extending from the plunger and fixed in relation thereto, wherein the protrusion extends into a longitudinal channel formed in an internal wall surface of the body portion.

19. The locking pin assembly of claim 1, wherein the shaft member and the plunger define a longitudinally extending reference axis, and a first cross-section of the body portion perpendicular to the reference axis adjacent a proximal end of the body portion comprises a first cross-sectional area, wherein a second cross-section of the body portion perpendicular to the reference axis adjacent a distal end of the body portion comprises a second cross-sectional area less than the first cross-sectional area, the body portion comprising an engagement surface along only one side that is parallel to the reference axis.

20. The locking pin assembly of claim 19, wherein the locking pin assembly is configured to be oriented within a bore extending through the ground engaging member and into the support structure such that at least a portion of the engagement surface engages a load bearing surface of the support structure defined by an internal wall of the bore.

21. The locking pin assembly of claim 20, wherein the load bearing surface is disposed on a side of the bore at which the locking pin assembly exerts a force in response to a force tending to remove the ground engaging member from the support structure.

22. A locking pin assembly for securing a ground engaging member to a support structure, comprising:

a body portion arranged to non-rotatably, selectively project into an opening in the support structure, the body portion having an opening formed therein;

a shaft member comprising a distal end and a proximal portion, the distal end having a first engagement feature, the distal end being disposed within the body portion, and wherein the shaft member defines a longitudinally extending reference axis;

a locking feature extending radially from the locking pin assembly, the shaft member being rotatable relative to the body portion between a first position in which the locking feature is positionable to mechanically inhibit removal of the locking pin assembly from the ground engaging member when positioned to secure the ground engaging member to the support structure and a second position in which the locking feature is positionable to permit removal of the locking pin assembly from the ground engaging member when positioned to secure the ground engaging member to the support structure;

a biasing member disposed within the body portion; and a plunger disposed between the biasing member and the distal end of the shaft member, the plunger comprising a second engagement feature configured to selectably engage the first engagement feature of the shaft member, wherein the biasing member urges the plunger toward the shaft member and the second engagement feature is configured to engage the first engagement feature to provide resistance during rotation of the shaft member relative to the plunger in each of two opposing directions;

wherein the body portion is shaped to be received within a bore extending through the ground engaging member and into the support structure such that when installed, the locking pin assembly is fixed in relation to the ground engaging member but movable relative to the support structure.

23. A locking pin assembly for securing a ground engaging member to a support structure, comprising:

a body portion arranged to selectively project into an opening in the support structure;

a shaft member comprising a distal end and a proximal portion, the distal end having a first engagement feature, the distal end being disposed within the body portion, wherein the shaft member is rotatable relative to the body portion between a locked position to secure the ground engaging member to the support structure and an unlocked position to permit removal of the ground engaging member from the support structure;

a biasing member disposed within the body portion; and a plunger disposed between the biasing member and the distal end of the shaft member, the plunger comprising a second engagement feature configured to selectably engage the first engagement feature of the shaft member, wherein the biasing member urges the plunger toward the shaft member and the second engagement feature is configured to engage the first engagement feature to provide resistance during rotation of the shaft member relative to the plunger in each of two opposing directions.

24. The locking pin assembly of claim 23, wherein the first engagement feature, the second engagement feature, and the biasing member are configured so that the resistance to rotation exerted by the biasing member occurs during a first portion of rotational travel and does not occur during a second portion of rotational travel, and wherein one of the first and second engagement features comprises two adjacent notches separated by a resistance peak, and the other of the first and second engagement features comprises a tooth configured to selectably seat within each of the two notches.

25. A method for locking a wear member to or removing a wear member from a nose carried on earth engaging equipment using a locking pin assembly, the method comprising:

first rotating, while the locking pin assembly is disposed within a bore passing through the wear member and the nose, a shaft member of the locking pin assembly relative to a body portion of the locking pin assembly in a first direction through a first range of motion in which a first surface of a tooth of the shaft member engages a corresponding first surface of a notch of a plunger disposed within the body portion, wherein the plunger is substantially rotationally fixed with respect to the body portion and rotation of the shaft member through the first range of motion axially displaces the plunger toward a biasing member from an initial position to a compressed position; and second rotating the shaft member relative to the body portion in the first direction through a second range of motion in which a second surface of the tooth slides relative to a corresponding second surface of a second notch, wherein during rotation of the shaft through the second range of motion the biasing member returns the plunger to the initial position; and wherein the first and second rotating moves a locking feature extending from the locking pin assembly from a first configuration to a second configuration, wherein when the locking feature is in one of the first and second configurations the locking feature interfaces with the wear member or the nose to prevent withdrawal of the locking pin assembly from the wear member and when the locking feature is in the other of the first and second configurations the locking pin assembly is removable from the wear member.

26. The method of claim 25, wherein the first range of motion comprises a range between 0 and 180 degrees; and wherein the second range of motion comprises a range between 0 and 180 degrees.

27. A locking pin assembly for securing a ground engaging member to a support structure, comprising:

a body portion arranged to non-rotatably, selectively project into an opening in the support structure, the body portion having an opening formed therein;

a shaft member having a first axis and comprising a distal end and a proximal portion, the distal end having a first plurality of equidistantly spaced teeth, the first plurality of equidistantly spaced teeth being spaced radially about the first axis in a range between about 30 degrees and 120 degrees apart, the distal end being disposed within the body portion;

a tang extending radially from the proximal portion of the shaft member outside the body portion, the shaft member being rotatable relative to the body portion between a first position in which the tang is positionable to mechanically inhibit removal of the locking pin assembly from the ground engaging member when positioned to secure the ground engaging member to the support structure and a second position in which the tang is positionable to permit removal of the locking pin assembly from the ground engaging member when positioned to secure the ground engaging member to the support structure;

a biasing member disposed within the body portion; and a plunger disposed between the biasing member and the distal end of the shaft member, the plunger having a second axis and comprising a second plurality of equidistantly spaced teeth, the second plurality of equidistantly spaced teeth being spaced radially about the second axis in a range between about 30 degrees and 120 degrees apart and shaped to selectively engage the first plurality of equidistantly spaced teeth of the shaft member to provide resistance to rotation in two opposing directions, wherein the first plurality of equidistantly spaced teeth and the second plurality of equidistantly spaced teeth are configured to rotate relative to one another when a rotational force applied to the shaft member exceeds a magnitude of the resistance to rotation exerted by the biasing member to rotate the shaft member from one of the first position and the second position to the other of the first position and the second position.

28. The locking pin assembly of claim 27, wherein the first and the second pluralities of equidistantly spaced teeth are shaped to provide about equal resistance to rotation in two directions.

29. The locking pin assembly of claim 27, wherein the first plurality of equidistantly spaced teeth, the second plurality of equidistantly spaced teeth, and the biasing member are configured so that the resistance to rotation exerted by the biasing member occurs during a first portion of rotational travel and does not occur during a second portion of rotational travel.

30. A locking pin assembly for securing a ground engaging member to a support structure, comprising:

a body portion arranged to non-rotatably, selectively project into an opening in the support structure, the body portion having an opening formed therein;

a shaft member having a first axis and comprising a distal end and a proximal portion, the distal end having a first tooth extending in an axial direction and offset from the first axis, the distal end being disposed within the body portion;

a tang extending radially from the proximal portion of the shaft member outside the body portion, the shaft member being rotatable relative to the body portion between a first position in which the tang is positionable to mechanically inhibit removal of the locking pin assembly from the ground engaging member when positioned to secure the ground engaging member to the support structure and a second position in which the tang is positionable to permit removal of the locking pin assembly from the ground engaging member when positioned to secure the ground engaging member to the support structure;

a biasing member disposed within the body portion; and a plunger disposed between the biasing member and the distal end of the shaft member, the plunger having a second axis and comprising a second tooth extending in a proximal direction and offset from the second axis, the second tooth engaging the first tooth to provide resistance during rotation in two opposing directions.

31. The locking pin assembly of claim 30, wherein one of the shaft member and the plunger comprises a notch adjacent the respective first tooth or second tooth, each of the first tooth and the second tooth sized to form a radial arc in a range between about 30 degrees and 120 degrees about the first axis and the second axis respectively.

* * * * *